US008297746B2

(12) United States Patent
Nakamura et al.

(10) Patent No.: US 8,297,746 B2
(45) Date of Patent: Oct. 30, 2012

(54) INK CARTRIDGE ACCOMMODATING DEVICE

(75) Inventors: Hirotake Nakamura, Nagoya (JP); Yasuhiro Kato, Nagoya (JP); Hirofumi Kondo, Tajimi (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 874 days.

(21) Appl. No.: 12/277,661

(22) Filed: Nov. 25, 2008

(65) Prior Publication Data

US 2009/0141096 A1 Jun. 4, 2009

(30) Foreign Application Priority Data

Nov. 30, 2007 (JP) ..... 2007-311678
Mar. 24, 2008 (JP) ..... 2008-076550

(51) Int. Cl.
*B41J 2/175* (2006.01)
*B41J 29/393* (2006.01)
*B41J 2/17* (2006.01)

(52) U.S. Cl. ..... 347/86; 347/19; 347/84; 347/85

(58) Field of Classification Search ..... 347/5, 6, 347/7, 19, 84, 85, 86
See application file for complete search history.

(56) References Cited

U.S. PATENT DOCUMENTS 6,422,674 B1 7/2002 Hinami et al.
2004/0113965 A1* 6/2004 Kosugi et al. ..... 347/19
2005/0195225 A1* 9/2005 Takagi et al. ..... 347/7
2006/0033789 A1 2/2006 Sasaki et al.
2007/0132819 A1 6/2007 Umeda et al.
2007/0154233 A1* 7/2007 Ukai ..... 399/90
2008/0180498 A1* 7/2008 Hattori et al. ..... 347/86

FOREIGN PATENT DOCUMENTS

| | | |
|---|---|---|
| JP | 04-020962 | 1/1992 |
| JP | 08-001958 | 9/1996 |
| JP | 10-128998 | 5/1998 |
| JP | 2784995 | 8/1998 |
| JP | 3351946 | 12/2002 |
| JP | 2004-202796 | 7/2004 |
| JP | 3667127 | 7/2005 |
| JP | 2005-246781 | 9/2005 |
| JP | 2005-262564 | 9/2005 |
| JP | 2005-313446 | 11/2005 |
| JP | 2007-152559 | 6/2007 |

* cited by examiner

*Primary Examiner* — Charlie Peng
*Assistant Examiner* — Hung Lam
(74) *Attorney, Agent, or Firm* — Frommer Lawrence & Haug LLP

(57) ABSTRACT

An ink cartridge accommodating device is provided. The ink cartridge accommodating device includes: an accommodating portion which is configured to accommodate a plurality of ink cartridges arranged in an arrangement direction; and a plurality of sensors which are provided correspondingly to the plurality of ink cartridges, and which optically detect information related to the plurality of ink cartridges, respectively. Each of the sensors includes a light-emitting element which emits light and a light-receiving element which receives light. The light-emitting elements or the light-receiving elements of adjacent sensors are arranged adjacent to each other.

17 Claims, 14 Drawing Sheets

INK CARTRIDGE ACCOMMODATING DEVICE

CROSS-REFERENCE TO RELATED APPLICATION

This application claims priority from Japanese Patent Application Nos. 2007-311678 filed on Nov. 30, 2007 and 2008-076550 filed on Mar. 24, 2008, the subject matter of which is incorporated herein by reference in its entirety.

TECHNICAL FIELD

Aspects of the present invention relate to an ink cartridge accommodating device including a mounting portion that can accommodate a plurality of ink cartridges arranged in a predetermined direction and sensors that are provided to correspond to the ink cartridges and optically detect information related to the ink cartridges.

BACKGROUND

An ink-jet recording apparatus uses ink to record images on a sheet. The ink-jet recording apparatus includes a mounting portion configured to mount thereon a plurality of ink cartridges. The ink cartridge is removably mountable on the mounting portion. Color inks are supplied from the ink cartridges to a recording head, the recording head selectively discharges ink from nozzles to the sheet. In this way, a color image is recorded on the sheet. In this type of ink-jet recording apparatus, an optical sensor is installed to the mounting portion or the ink cartridge in order to detect the amount of ink stored in the ink cartridge (for example, see JP-A-2007-152559).

FIGS. 14A and 14B are perspective views illustrating an optical sensor 280 used for a related-art ink-jet recording apparatus. FIG. 14A is a perspective view illustrating the internal configuration of the optical sensor 280, and FIG. 14B is a perspective view illustrating a plurality of optical sensors 280 attached to a wall 285 of the mounting portion. As shown in FIG. 14A, the optical sensor 280 includes a light-emitting element 281 and a light-receiving element 282. The light-emitting element 281 and the light-receiving element 282 are provided in a substantially U-shaped resin housing 283. The housing 283 is formed in a U-shape by coupling a plurality of members. A gap is formed between the members due to an undefined factor, such as a manufacturing tolerance. Light emitted from the light-emitting element 281 can leak from such gap. Therefore, in the related-art inkjet recording apparatus, as shown in FIG. 14B, the optical sensors 280 are arranged in the same direction, and partition plates 286 are provided between the sensors 280. In this way, light leaking from the gap between adjacent optical sensors 280 is shielded by the partition plate 286, and the light leaking from the gap is reduced or prevented from being incident on the light-receiving element 282 of another optical sensor 280. Therefore, it is possible to prevent the detection error of the optical sensor 280 due to light leakage.

However, when the partition plates 286 (see FIGS. 14A, 14B) are provided on the mounting portion, for mounting the ink cartridge, at least a space corresponding to the thickness of the partition plates 286 is reduced from the entire space. Therefore, it is necessary to increase the width of the mounting portion by a value corresponding to the thickness of the partition plates. If the size of the mounting portion increases, the size of the ink-jet recording apparatus also increases. In order to reduce the size of the mounting portion, it is conceivable that the partition plates 286 (see FIGS. 14A, 14B) are removed to reduce the gap between the ink cartridges and the gap between the optical sensors 280. However, in this case, the problem of the detection error of adjacent optical sensors 280 due to light leaking from the gap of the housing 283 arises.

SUMMARY

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly, it is an aspect of the present invention to provide a small ink cartridge accommodating device capable of reducing the width of a mounting portion by appropriately arranging optical sensors.

According to an exemplary embodiment of the present invention, there is provided an ink cartridge accommodating device including: an accommodating portion which is configured to accommodate a plurality of ink cartridges arranged in an arrangement direction; and a plurality of sensors which are provided correspondingly to the plurality of ink cartridges, and which optically detect information related to the plurality of ink cartridges, respectively. Each of the sensors includes a light-emitting element which emits light and a light-receiving element which receives light. The light-emitting elements or the light-receiving elements of adjacent sensors are arranged adjacent to each other.

According to another exemplary embodiment of the present invention, there is provided an ink cartridge accommodating device including: an accommodating portion which is configured to accommodate a plurality of ink cartridges arranged in a first direction; and a plurality of sensors, each including: a light-emitting element which emits light; and a light-receiving element which receives light and faces the light-emitting element in the first direction with a portion of the corresponding one of the ink cartridges being therebetween. A direction from the light-emitting element to the light-receiving element of one of the sensors is opposite to a direction from the light-emitting element to the light-receiving element of another one of the sensors adjacent to the one of the sensors.

BRIEF DESCRIPTION OF THE DRAWINGS

The above and other aspects of the present invention will become more apparent and more readily appreciated from the following description of exemplary embodiments of the present invention taken in conjunction with the attached drawings, in which:

FIG. 1A is a perspective view illustrating a slider disposed at a first position, and FIG. 1B is a perspective view illustrating the slider disposed at a second position;

FIG. 2A is a side view illustrating the slider disposed at the first position, and FIG. 2B is a side view illustrating the slider disposed at the second position;

FIG. 3A is a perspective view illustrating the body, as viewed from a front surface, and FIG. 3B is a perspective view illustrating the body, as viewed from a rear surface;

DETAILED DESCRIPTION

Hereinafter, illustrative non-limiting exemplary embodiments of the present invention will be described with reference to the accompanying drawings. It will be understood by those skilled in the art that various changes in form and details may be made therein without departing from the spirit and scope of the invention as defined by the appended claims.

[Ink Cartridge 100]

Figure 1B:
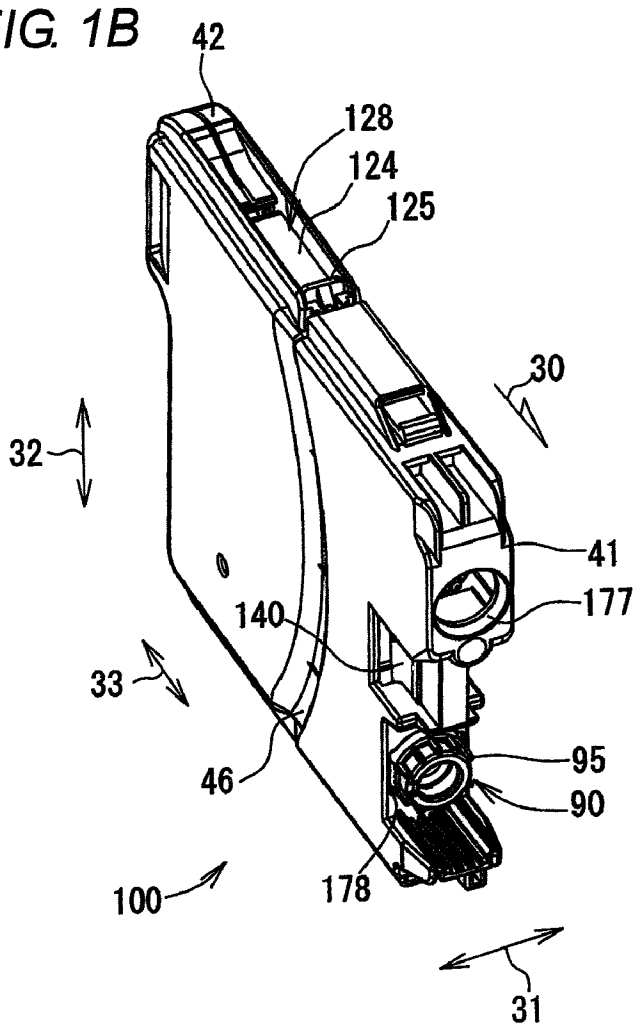
FIGS. 1A and 1B are perspective views illustrating the external configuration of an ink cartridge according to an exemplary embodiment of the present invention, specifically.
Figure 1A:
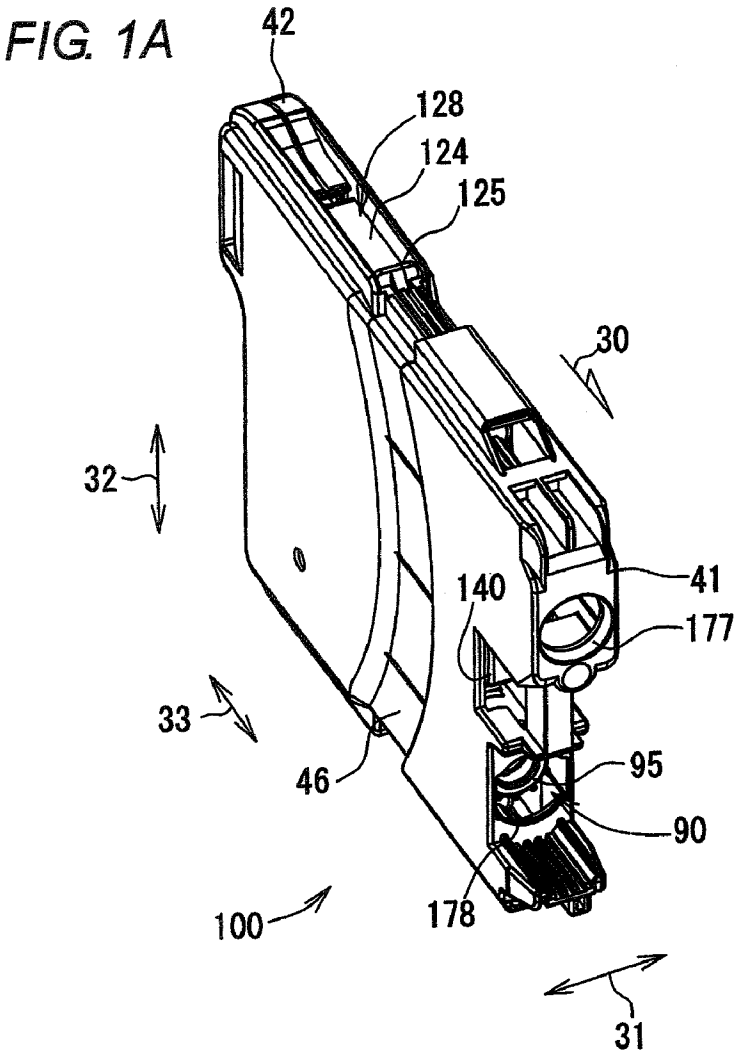
Figure 2A:
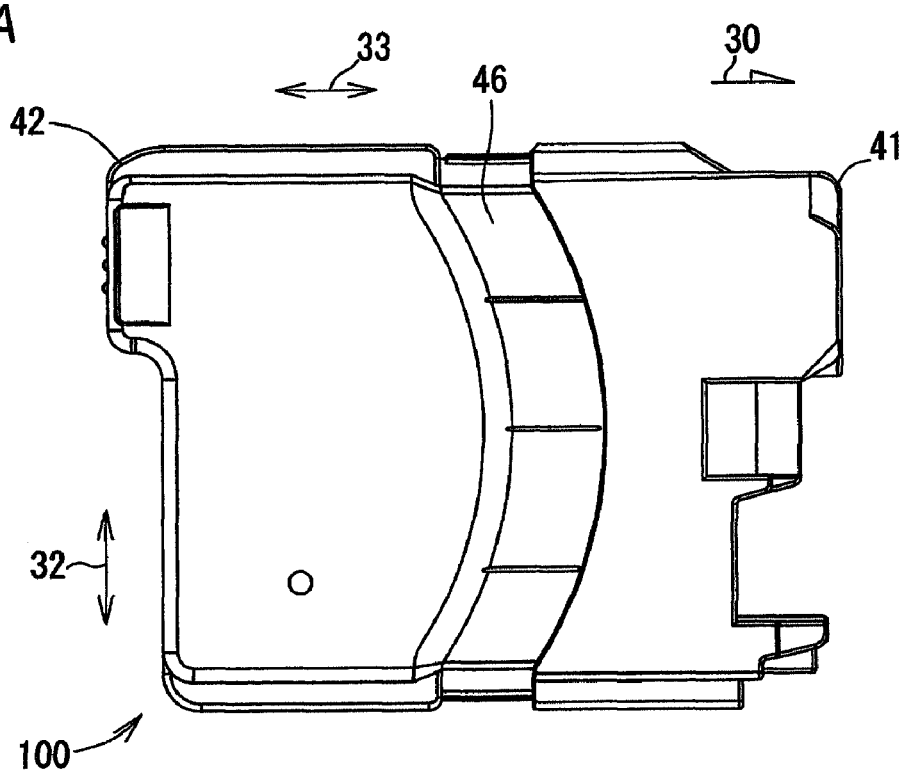
FIGS. 2A and 2B are side views illustrating the ink cartridge, specifically.
Figure 2B:
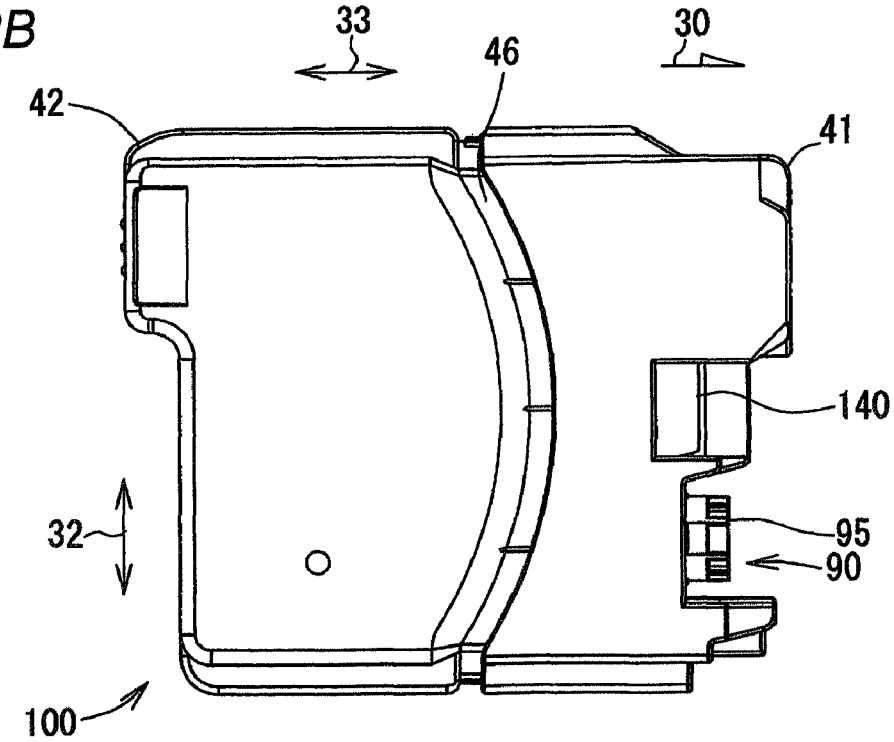
Figure 3B:
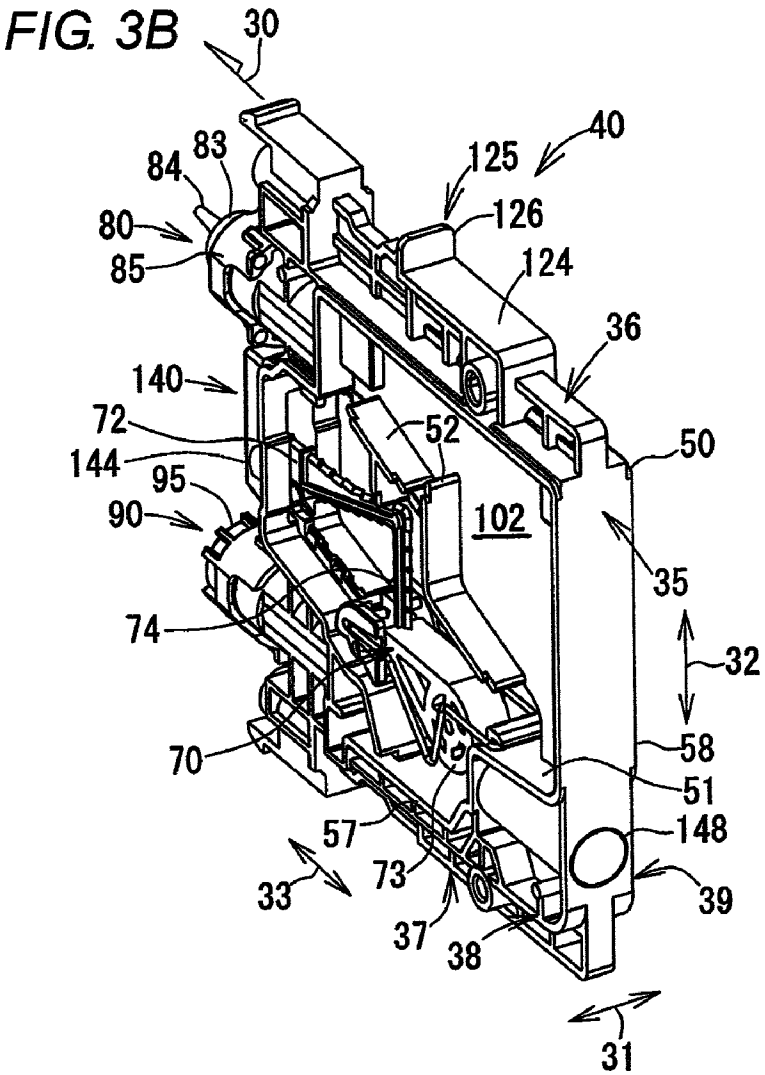
FIGS. 3A and 3B are perspective views illustrating the configuration of a body of the ink cartridge, specifically.
Figure 3A:
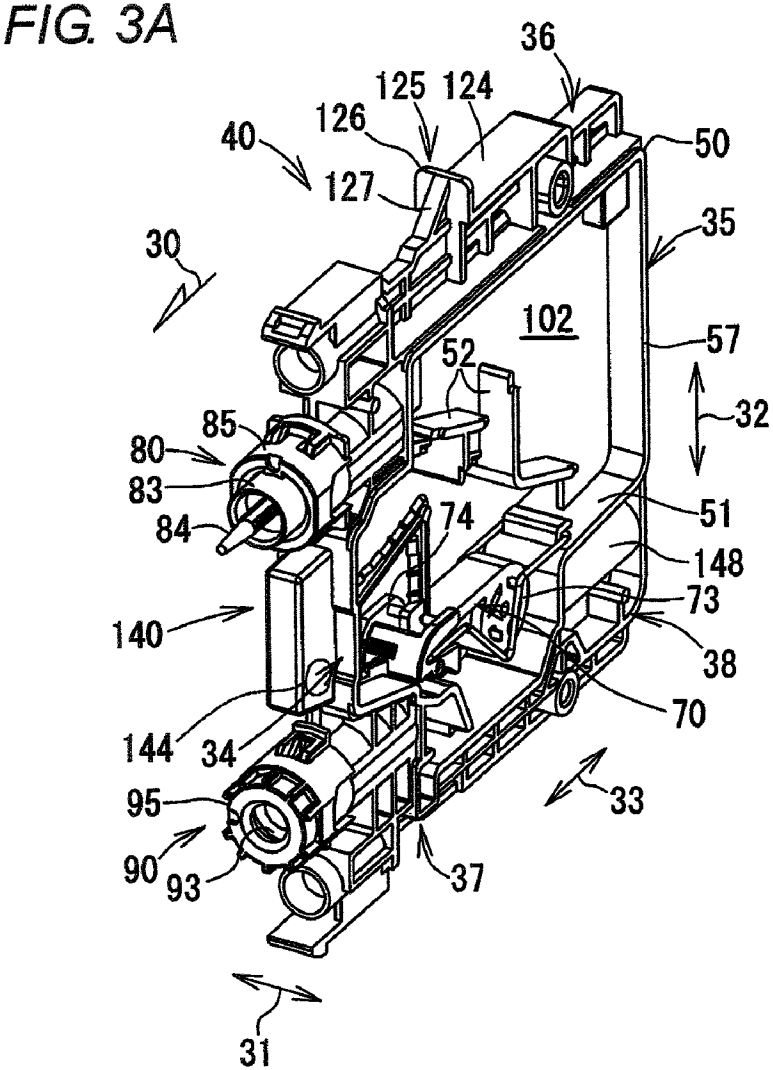

Next, an ink cartridge 100 for an ink-jet image recording apparatus will be described with reference to FIGS. 1A to 3B. The ink cartridge 100 is configured to removably mountable on a base unit 200 (see FIG. 4), which will be described below, provided in the image recording apparatus. FIGS. 1A and 1B are perspective views illustrating the external configuration of the ink cartridge 100. Specifically, FIG. 1A is a perspective view illustrating a slider 41 disposed at a first position, and FIG. 1B is a perspective view illustrating the slider 41 disposed at a second position. FIGS. 2A and 2B are side views illustrating the ink cartridge 100. Specifically, FIG. 2A is a side view illustrating the slider 41 disposed at the first position, and FIG. 2B is a side view illustrating the slider 41 disposed at the second position. FIGS. 3A and 3B are perspective views illustrating the configuration of a body 40. Specifically, FIG. 3A is a perspective view illustrating the body 40, as viewed from a front surface 34, and FIG. 3B is a perspective view illustrating the body 40, as viewed from a rear surface 35.

As shown in FIGS. 1A to 2B, the ink cartridge 100 has a substantially hexahedral shape. Specifically, the ink cartridge 100 has a substantially rectangular parallelepiped shape that has a small width (in the direction of an arrow 31) and a height (in the direction of an arrow 32) and a depth (in the direction of an arrow 33) that are larger than the width. The ink cartridge 100 is inserted into (mounted on) the base unit 200 (see FIG. 4) in the direction of an arrow 30 (hereinafter, referred to as an 'insertion direction 30') in an erected state shown in FIGS. 1A to 2B, that is, with the bottom thereof facing downward and the top thereof facing upward in the drawings.

The ink cartridge 100 includes the body 40 (see FIGS. 3A, 3B) having ink stored therein, the slider 41, and a body cover 42. The external configuration of the ink cartridge 100 includes the slider 41 and the body cover 42. The body 40 is covered with the slider 41 and the body cover 42. In this exemplary embodiment, the body 40, the slider 41, and the body cover 42 are made of a resin material. Examples of the resin material include nylon, polyethylene, and polypropylene.

The body cover 42 covers substantially the entire body 40 (see FIGS. 3A, 3B). Specifically, the body cover 42 covers most of the body 40 except for a portion of the upper surface 36 (see FIGS. 3A, 3B) of the body 40 and the front surface 34 (see FIGS. 3A, 3B) of the body 40. In this way, most of the body 40, particularly, side surfaces 38 and 39 (see FIGS. 3A, 3B) of the body 40 are protected from an external impact. Since the configuration of the body cover 42 is not related to the present invention, a detailed description thereof will be omitted.

The slider 41 is attached to the body 40 through a coil spring (not shown). With the body cover 42 coupled to the body 40 (see FIGS. 3A, 3B), the slider 41 covers a front portion 46 of the body 40 in the insertion direction 30 of the body cover 42 and the front surface 34 (see FIGS. 3A, 3B) of the body 40. The slider 41 is configured so as to slide in the depth direction (in the direction of the arrow 33) of the ink cartridge 100. FIGS. 1A and 2A show the slider 41 disposed at the first position that is furthest away from the front surface 34 (see FIGS. 3A, 3B) of the body 40 in the insertion direction 30, and FIGS. 1B and 2B show the slider 41 disposed at the second position that is closest to the front surface 34 of the body 40.

The slider 41 includes openings 177 and 178. The opening 177 is formed at a position corresponding to an air communicating valve 80, which will be described below. The opening 178 is formed at a position corresponding to an ink supply valve 90, which will be described below. Therefore, even when the slider 41 is attached to the body 40, the air communicating valve 80 and the ink supply valve 90 are exposed to the outside through the openings 177 and 178, respectively. As shown in FIGS. 1A to 2B, when the slider 41 slides from the first position to the second position against the urging force of the coil spring, a cap 95 (see FIGS. 3A and 3B) of the ink supply valve 90 is exposed to the outside. When the slider 41 slides from the second position to the first position, the cap 95 is inserted into the slider 41. Since the configuration of the slider 41 and a mechanism for sliding the slider 41 are not related to the present invention, a detailed description thereof will be omitted in this exemplary embodiment.

[Body 40]

Next, the body 40 of the ink cartridge 100 will be described. As shown in FIGS. 3A and 3B, the body 40 has substantially the same shape as the ink cartridge 100. That is, the body 40 has a substantially hexahedral shape. In this exemplary embodiment, as shown in FIGS. 3A and 3B, a surface of the body 40 that is on the front side in the insertion direction 30 is referred to as the front surface 34, a surface of the body that is on the rear side in the insertion direction 30 is referred to as the rear surface 35, a surface of the body that is on the upper side in the vertical direction is referred to as an upper surface 36, and a surface of the body that is on the lower side in the vertical direction is referred to as a lower surface 37. In addition, two surfaces that are adjacent to the front surface 34, the rear surface 35, the upper surface 36, and the lower surface 37 and face each other are referred to as the side surfaces 38 and 39. As viewed from the rear surface 35, the left side is the left surface 38, and the right side is the right surface 39. A pair of the side surfaces 38 and 39 has the largest area in the body 40. In this exemplary embodiment, the surfaces 34 to 39 do not indicate specific planes, but are defined as all the surfaces of the body 40, as viewed from the front side of the body 40.

The body 40 includes a frame 50, an arm 70, the air communicating valve 80, the ink supply valve 90, and a thin transparent film (not shown) adhered to the frame 50. In FIGS. 3A and 3B, the film is not shown.

The frame 50 is a member forming the casing of the body 40. The frame 50 forms the six surfaces 34 to 39 of the body 40. Therefore, the six surfaces 34 to 39 of the body 40 are the same as the six surfaces of the frame 50. In the following description, reference numerals given to the six surfaces of the body 40 denote the six surfaces of the frame 50.

The frame 50 is formed of a translucent member, for example, a transparent or translucent resin material. The frame 50 is formed of a resin material by injection molding. Examples of the resin material include polyacetal, nylon, polyethylene, and polypropylene.

As shown in FIGS. 3A and 3B, the frame 50 includes an outer wall 51 and a plurality of inner walls 52. The inner walls 52 are arranged inside the outer wall 51. The outer wall 51 and the inner walls 52 are integrally formed with the frame 50. The outer wall 51 and the inner walls 52 are provided between the left side surface 38 and the right side surface 39 of the body 40. The outer wall 51 is provided in a ring shape along the front surface 34, the upper surface 36, the rear surface 35, and the lower surface 37 such that a space is formed inside the outer wall. In this way, an opening 57 is formed in the left side surface 38 of the frame 50, and an opening 58 is formed in the right side surface 39.

The films are adhered to the edges of the two side surfaces 38 and 39 (the left and right surfaces of FIGS. 3A and 3B) of the frame 50, that is, the edge of the outer wall 51 facing the side surfaces 38 and 39 by a known thermal adhesion method. The films cover the openings 57 and 58. In this way, a space surrounded by the outer wall 51 and the films is partitioned as an ink chamber 102. Ink is stored in the partitioned ink chamber 102. In this exemplary embodiment, the ink chamber 102 is formed by the frame 50 and the films, but the present invention is not limited thereto. For example, the frame 50 may be formed in a rectangular parallelepiped shape, and the ink chamber 102 may be formed in the frame.

The inner walls 52 are provided in the space surrounded by the outer wall 51. The films are also adhered to the edges of the inner walls 52 facing the side surfaces 38 and 39. In this way, it is possible to prevent the films from being detached. In addition, even when the slider 41 and the body cover 42 are deformed toward the body 40, the inner walls 52 prevent the deformation of the slider 41 and the body cover 42.

As shown in FIGS. 3A and 3B, an ink injection portion 148 is formed in the rear surface 35 of the frame 50. The ink injection portion 148 is a hole that has a substantially cylindrical shape and is formed from the rear surface 35 to the ink chamber 102. The ink injection portion 148 communicates with the ink chamber 102. The ink injection portion 148 is for injecting ink into the ink chamber 102, and ink flows into the ink chamber 102 through the ink injection portion 148. The ink injection portion 148 is formed integrally with the frame 50 in the vicinity of the lower end of the rear surface 35. After ink is injected into the ink chamber 102, the ink injection portion 148 is closed by a rubber stopper.

A detecting portion 140 is formed on the front surface 34 of the frame 50. The detecting portion 140 is for visually or optically detecting the amount of ink stored in the ink chamber 102. The detecting portion 140 is formed integrally with the frame 50. Therefore, the detecting portion 140 is formed of the same material as that forming the frame 50. That is, the detecting portion 140 is made of a transparent or opaque resin material capable of transmitting light. The detecting portion 140 can transmit light incident from the outside.

The detecting portion 140 has a substantially rectangular parallelepiped shape. The detecting portion 140 protrudes from a middle portion of the front surface 34 of the body 40 to the outside of the body 40. The detecting portion 140 is partitioned by five walls having substantially rectangular shapes, and has a space therein. A space surrounded by the walls is formed inside the detecting portion 140. One surface of the detecting portion 140 facing the ink chamber 102 is opened such that the detecting portion 140 communicates with the chamber 102.

When the ink cartridge 100 is inserted into the base unit 200, the detecting portion 140 enters an optical path 183 (see FIG. 6) of an optical sensor 181 (see FIG. 4), such as a photo interrupter, provided in the base unit 200. A radiation region 144 (represented by a dotted line in FIG. 3A) is formed below the detecting portion 140. The detecting portion 140 is inserted such that the radiation region 144 and the optical path 183 intersect each other. Light emitted from the optical sensor 181 is incident on the radiation region 144. The optical sensor 181 includes a light-emitting element 154 (see FIG. 7) and a light-receiving element 155 (see FIG. 7). In this exemplary embodiment, light emitted from the light-emitting element 154 is incident on the radiation region 144.

The arm 70 is provided in the body 40, that is, the ink chamber 102. The arm 70 is made of a light-shielding resin material. The arm 70 is pivotably supported by a rib 74 that is vertically provided at the center of the outer wall 51 in the width direction (in the direction of the arrow 31). A floating portion 73 that serves as a floating member is provided at one end of the arm 70. The floating portion 73 is vertically moved depending on the amount of ink in the ink chamber 102. An indicator 72 arranged in the detecting portion 140 is provided at the other end of the arm 70.

When the floating portion 73 is vertically moved depending on the amount of ink in the ink chamber 102, the arm 70 is pivotad, and the indicator 72 is moved in the vertical direction in the inner space of the detecting portion 140. Specifically, the indicator 72 is movable between a first position where the indicator is disposed inside the radiation region 144 and a second position where the indicator is disposed outside the radiation region 144. When the indicator 72 that is moved in the vertical direction is detected by the optical sensor 181 (see FIG. 4) through the detecting portion 140, it is possible to obtain information indicating whether the amount of ink is more than a threshold value.

As shown in FIGS. 3A and 3B, the air communicating valve 80 is provided at an upper part of the front surface 34 of the frame 50, that is, above the detecting portion 140. The air communicating valve 80 is a valve that closes or opens an air passage extending from an opening (not shown) formed in the front surface 34 to the ink chamber 102. For example, the air communicating valve 80 includes a valve body (not shown) that is slidably supported in the air passage, a spring (not shown) that urges the valve body, a seal member 83 that is provided at the edge of the opening, a rod 84 that is connected to the valve body, and a cap 85 that fixes the seal member 83. The cap 85 and the seal member 83 are provided with through holes (not shown). The through holes form an air communicating hole through which the air passage communicates with the outside. The rod 84 is inserted into the air communicating hole to be exposed to the outside. When the rod 84 is pressed, the air communicating hole is opened, and the internal pressure of the ink chamber 102 becomes equal to the atmospheric pressure. The air communicating valve 80 has a known configuration, and a detailed description thereof will be omitted in this exemplary embodiment.

The ink supply valve 90 is provided at a lower part of the front surface 34 of the frame 50, that is, below the detecting portion 140. The ink supply valve 90 is a valve that closes or opens an ink passage extending from an opening (not shown) formed in the front surface 34 to the ink chamber 102. For example, the ink supply valve 90 includes a valve body (not shown) that is slidably supported in the ink passage, a spring (not shown) that urges the valve body, a seal member 93 that is provided at the edge of the opening, and a cap 95 that fixes the seal member 93. The cap 95 and the seal member 93 are provided with through holes (not shown). The through holes form an ink supply port through which the ink passage communicates with the outside. When a tubular ink needle 209 (see FIG. 4) is inserted into the ink supply port, the ink passage and the inner hole of the ink needle 209 communicate with each other. In this way, it is possible to supply ink to a recording head (not shown) of an ink recording apparatus. The ink supply value 90 has a known configuration, and a detailed description thereof will be omitted in this exemplary embodiment.

As shown in FIGS. 3A and 3B, a table portion 124 is provided on the upper surface 36 of the frame 50. The table portion 124 extends from a middle portion of the upper surface 36 in the depth direction (in the direction of the arrow 33) backward in the insertion direction 30. The table portion 124 is exposed to the outside through an opening 128 (see FIGS. 1A, 1B) formed in the upper surface of the body cover 42, with the body 40 being covered with the body cover 42. The rear end of the table portion 124 does not reach the rear surface 35.

A stopper 125 is provided on the table portion 124 so as to protrude from the table portion 124 upward. The stopper 125 is provided at the leading end of the table portion 124 in the insertion direction 30. The stopper 125 includes a vertical wall 126 that is vertical with respect to the table portion 124 and an inclined rib 127 that is inclined from the top of the vertical wall 126 downward to the front side of the upper surface 36 in the insertion direction 30 at an angle of about 45°. When the ink cartridge 100 is inserted into the base unit 200, the stopper 125 is used to fix the ink cartridge 100 such that the ink cartridge 100 is not detached from the base unit 200. The ink cartridge 100 is fixed by engagement between the stopper 125 and a lock lever 230 (see FIG. 4), which will be described below.

[Base Unit 200]

Figure 4:
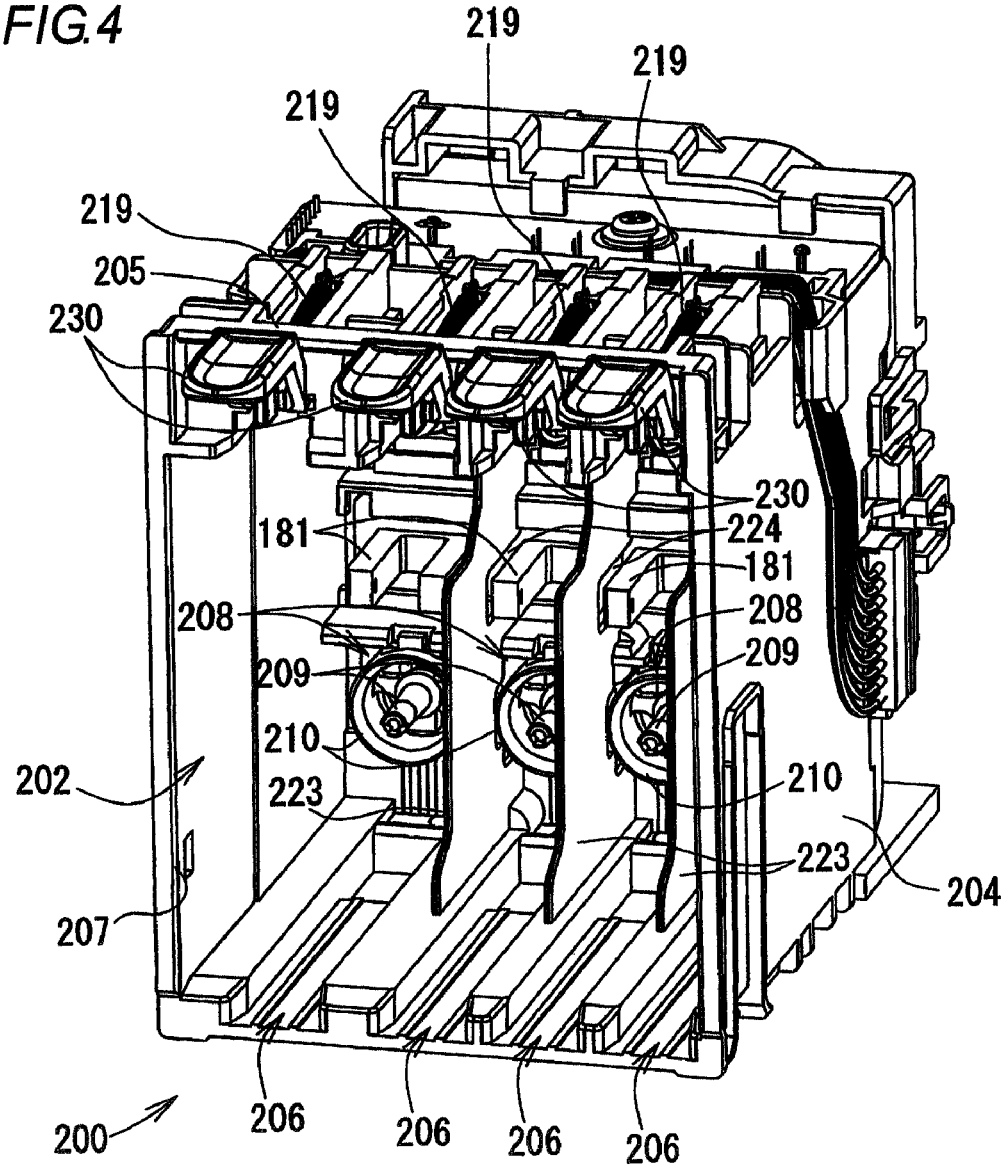
FIG. 4 is a perspective view illustrating the configuration of a base unit according to an exemplary embodiment of the present invention.
Figure 5:
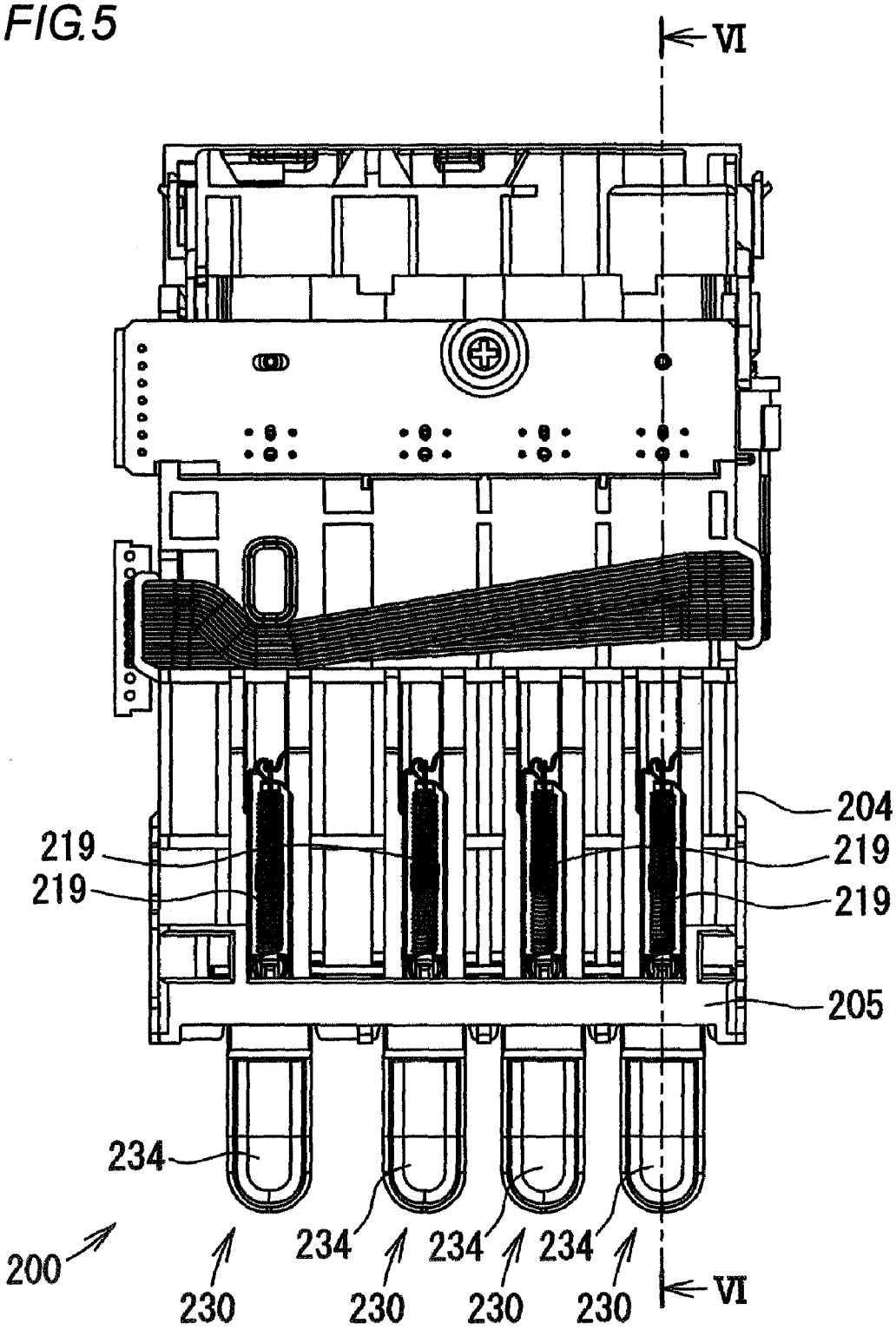
FIG. 5 is a plan view illustrating the base unit.
Figure 6:
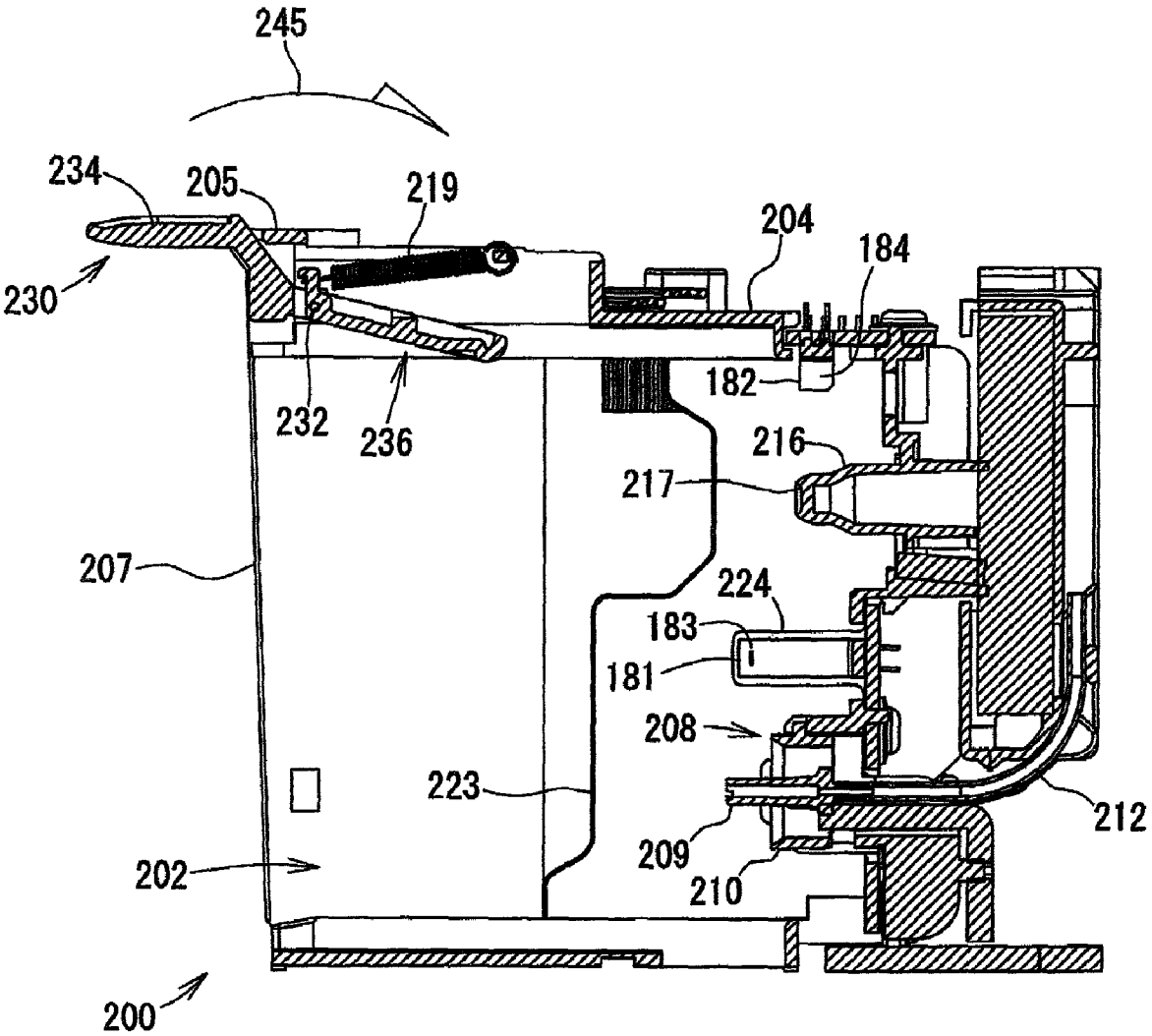
FIG. 6 is a cross-sectional view taken along the line VI-VI of FIG. 5.
Figure 7:
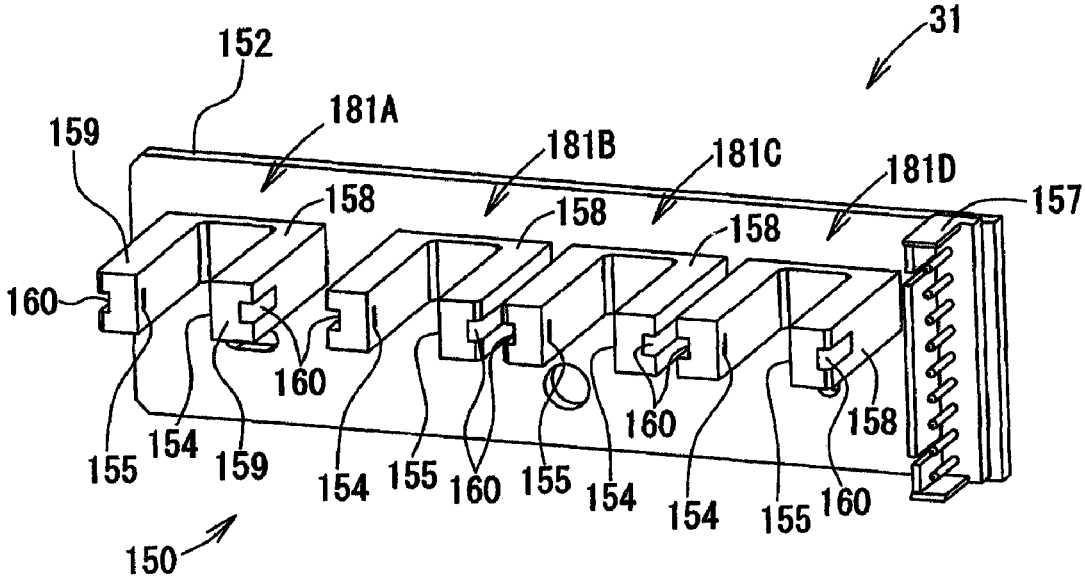
FIG. 7 is a perspective view illustrating a sensor unit according to an exemplary embodiment of the present invention.
Figure 8:
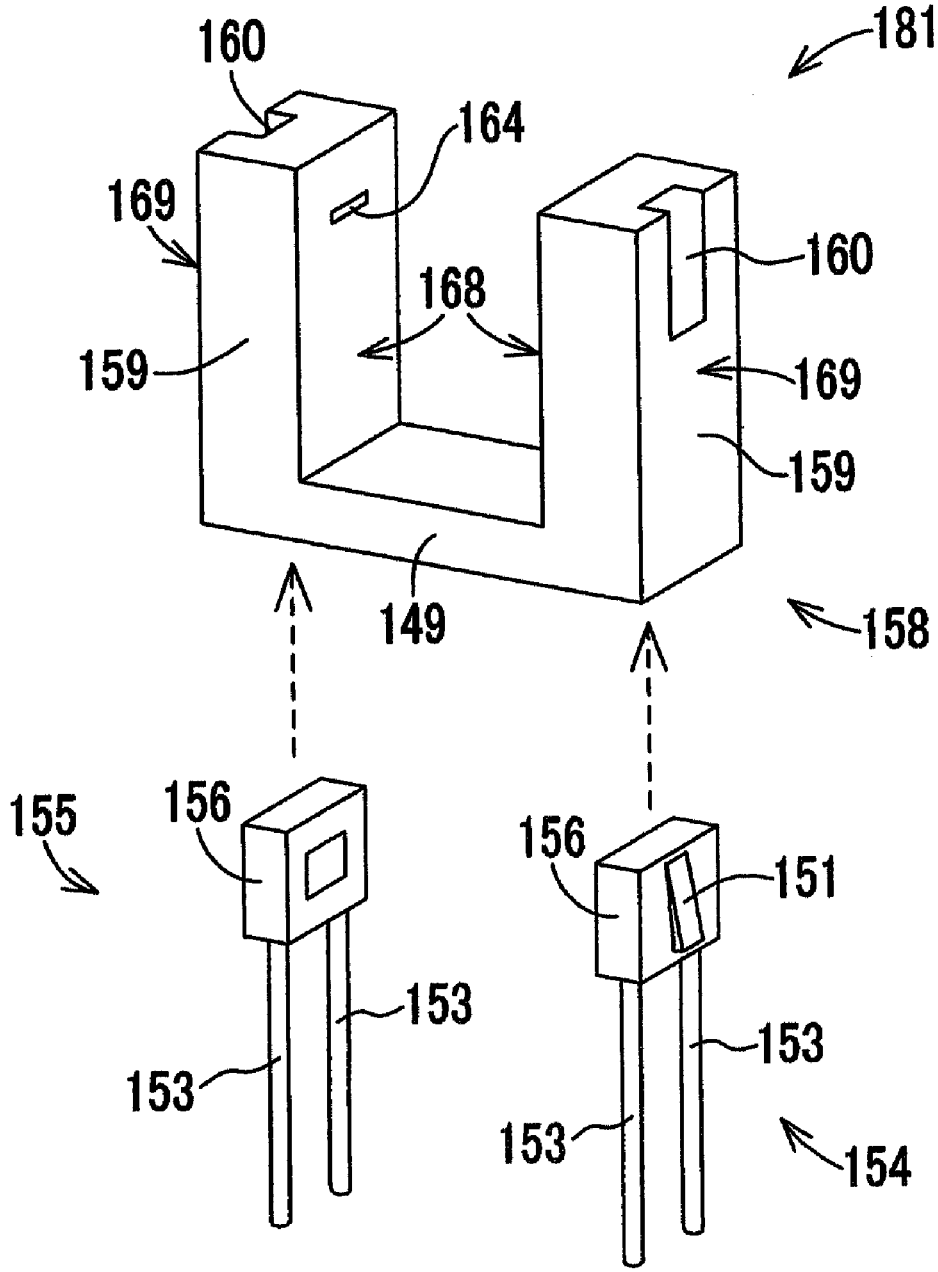
FIG. 8 is an exploded perspective view illustrating an optical sensor according to an exemplary embodiment of the present invention.
Figure 9:
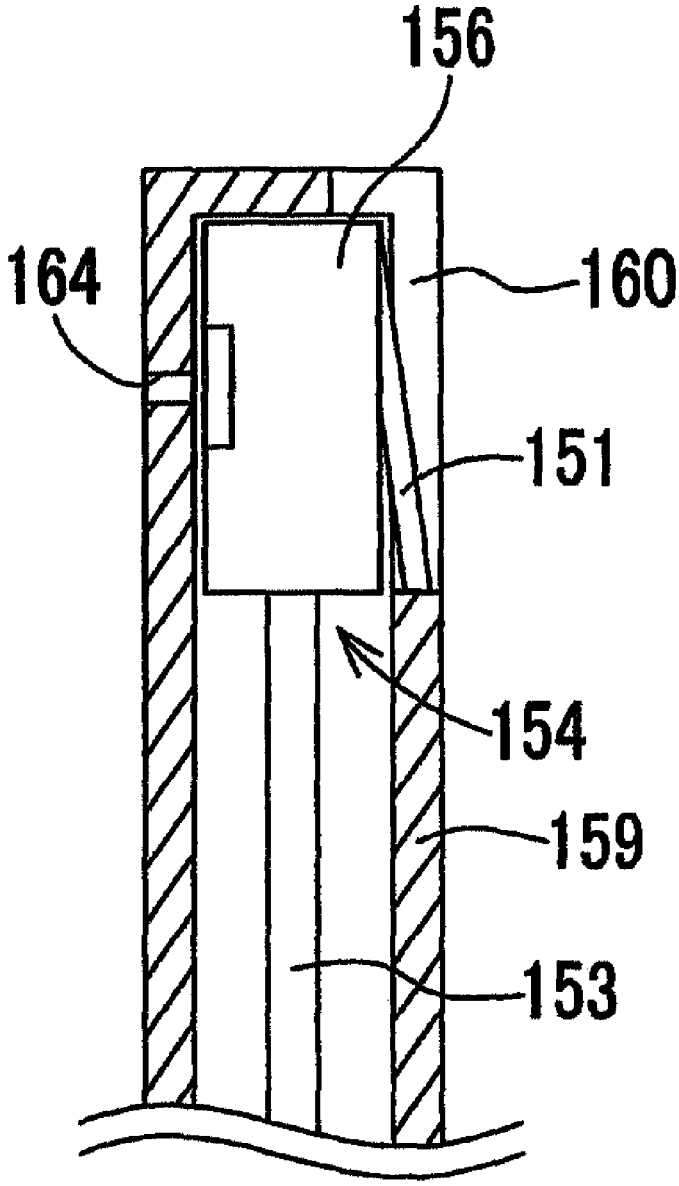
FIG. 9 is a partial longitudinal sectional view illustrating a protruding portion of the optical sensor.
Figure 10:
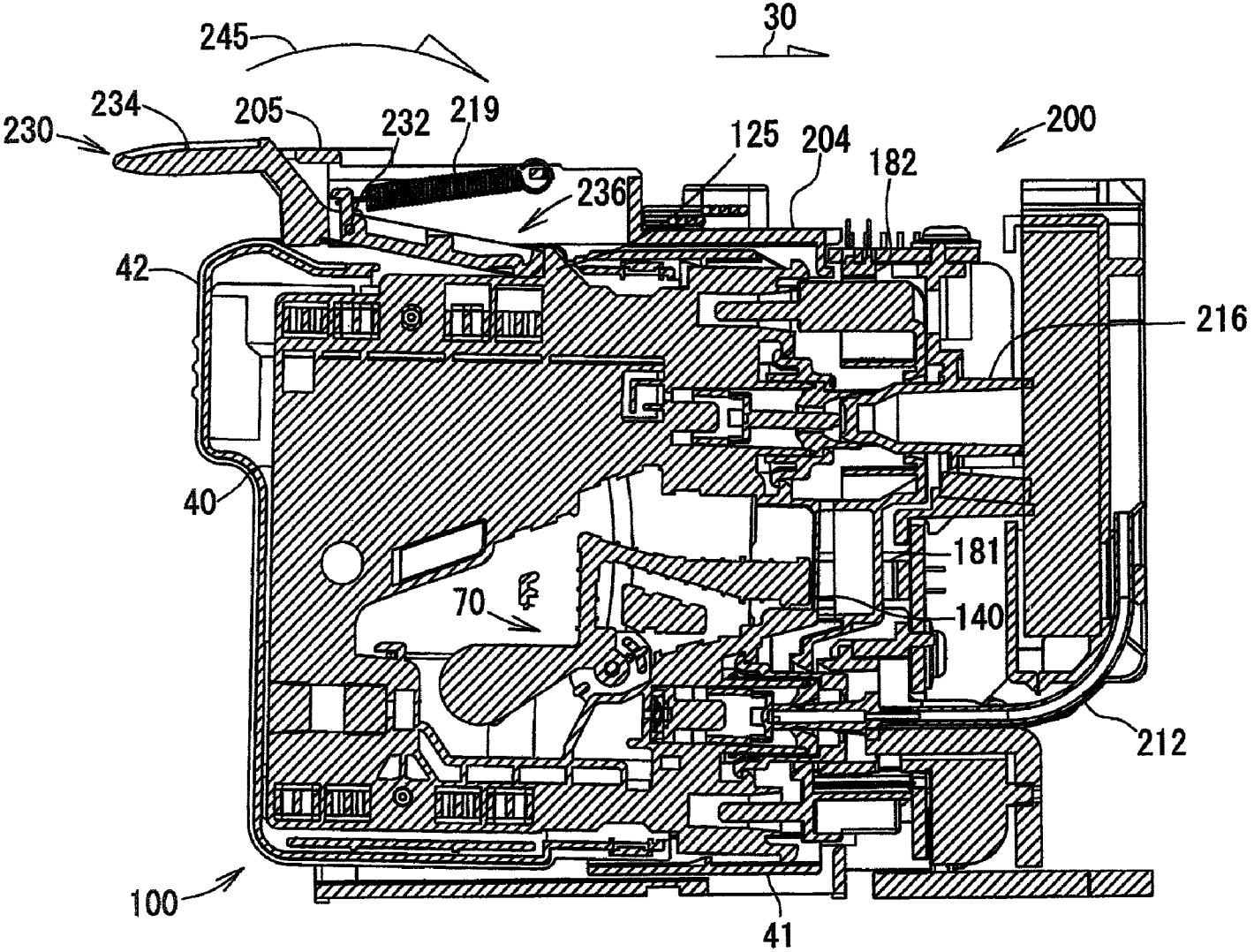
FIG. 10 is a longitudinal sectional view illustrating the ink cartridge inserted and fixed to a cartridge mounting portion according to an exemplary embodiment of the present invention.

Next, the configuration of the base unit 200 will be described with reference to FIGS. 4 to 10. The base unit 200 is provided in an ink-jet image recording apparatus. FIG. 4 is a perspective view illustrating the configuration of the base unit 200. FIG. 5 is a plan view illustrating the base unit 200. FIG. 6 is a cross-sectional view taken along the line VI-VI of FIG. 5. FIG. 7 is a perspective view illustrating a sensor unit 150. FIG. 8 is an exploded perspective view illustrating the optical sensor 181. FIG. 9 is a partial longitudinal sectional view illustrating a protruding portion 159 of the optical sensor 181. FIG. 10 is a longitudinal sectional view illustrating the ink cartridge 100 inserted and fixed to a cartridge mounting portion (accommodating portion) 202.

As shown in FIG. 4, the base unit 200 includes a frame 204 that is formed in the shape of a container having an opening 207 formed in the front surface. The inter space of the frame 204 accommodates the cartridge mounting portion 202 configured to accommodate the ink cartridges 100. The cartridge mounting portion 202 is capable of accommodating four ink cartridges 100 corresponding to cyan, magenta, yellow, and black. In this exemplary embodiment, the base unit 200 is provided in the image recording apparatus such that the opening 207 is exposed from the front surface of the image recording apparatus. Therefore, the ink cartridge 100 can be inserted into or removed from the base unit 200 through the opening 207 arranged in the front surface of the image recording apparatus.

As shown in FIGS. 4 and 6, three plates 223 that partition the inner space into four longitudinal spaces are provided in the cartridge mounting portion 202. The ink cartridges 100 are accommodated in the spaces partitioned by the plates 223. The plates 223 are formed on the inner rear surface of the cartridge mounting portion 202. The plates 223 are vertically provided on the inner rear surface of the frame so as to protrude toward the opening 207. The plates 223 are arranged in the width direction of the base unit 200. Each of the plates 223 has a rectangular cutout 224. The cutout 224 is formed so as to have a size corresponding to the shape of the optical sensor 181, which will be described below. Specifically, as shown in FIG. 6, the size of the cutout is larger than that of the optical sensor 181 in a side view. In other words, the cutout 224 is larger than the projection of the optical sensor 181 when projected on the partition plate 223. Therefore, a gap between the adjacent optical sensors 181 in the lateral direction is smaller than the thickness of the plate 223.

Four guide grooves 206 are formed in the bottom of the frame 204. The guide grooves 206 are for smoothly guiding the ink cartridges 100 to the inner rear surface of the cartridge mounting portion 202. The guide grooves 206 extend straight in the depth direction of the base unit 200. The guide grooves 206 are arranged at specific intervals in the width direction of the base unit 200. The leftmost guide groove 206 has a width that is larger than those of the other guide grooves 206, in order to enable the black ink cartridge having a width that is larger than those of the other ink cartridges to be inserted. The lower ends of the ink cartridges 100 are guided by the guide grooves 206 in the depth direction and the ink cartridges 100 are smoothly inserted into the cartridge mounting portion 202.

Connecting portions 208 connected to the ink supply ports of the ink supply valve 90 are provided at a lower part of the inner rear surface of the cartridge mounting portion 202. The connecting portions 208 are arranged on the inner rear surface at positions corresponding to the ink supply valves 90 of the ink cartridges 100. In this exemplary embodiment, four connecting portions 208 corresponding to four ink cartridges 100 capable of being inserted into the cartridge mounting portion 202 are provided. In FIG. 4, the rightmost connecting portion 208 is concealed by the side wall of the frame 204.

Each of the connecting portions 208 includes the ink needle 209 and a holding portion 210. The ink needle 209 is a tubular resin needle. As shown in FIG. 6, the ink needle 209 is connected to a flexible ink tube 212 on the rear surface of the base unit 200. The ink tube 212 extending from the ink needle 209 to the rear surface is bent upward along the rear surface of the base unit 200, and extends to a recording head (not shown) of the image recording apparatus.

The holding portion 210 is formed in a concave shape. The ink needle 209 is provided at the center of the holding portion 210. When the ink cartridge 100 is inserted into the cartridge mounting portion 202, the cap 95 (see FIG. 1B) is inserted into the concave portion of the holding portion 210. In this case, the circumferential surface of the cap 95 comes into close contact with the inner surface of the concave portion of the holding portion 210. In this way, the cap 95 and the holding portion 210 are tightly connected to each other.

Pressing portions 216 (see FIG. 6) each pressing the rod 84 of the air communicating valve 80 are provided at upper parts of the inner rear surface of the cartridge mounting portion 202. The pressing portions 216 are arranged on the inner rear surface at positions corresponding to the air communicating valves 80. In this exemplary embodiment, four pressing portions 216 corresponding to four ink cartridges 100 capable of being inserted into the cartridge mounting portion 202 are provided. As shown in FIG. 6, the pressing portion 216 protrudes from the inner rear surface in the vertical direction. A concave portion 217 is formed at the end of the protruding portion of the pressing portion 216. When the ink cartridge 100 is inserted into the cartridge mounting portion 202, the pressing portion 216 passes through the opening 177 and contacts the leading end of the rod 84. In this case, the rod 84 is reliably fixed by the concave portion 217. When the pressing force of the pressing portion 216 is applied to the rod 84, the rod 84 is moved backward, and the air communicating hole of the air communicating valve 80 is opened.

The sensor unit 150 is provided above the connecting portions 208 on the inner rear surface of the cartridge mounting portion 202. The sensor unit 150 includes a substrate 152, the optical sensors 181, and a connector 157. The optical sensors 181 and the connector 157 are mounted on the substrate 152 to configure the sensor unit 150. The sensor unit 150 is mounted from the rear side of the base unit 200.

As shown in FIG. 7, the sensor unit 150 is provided with four optical sensors 181 (181A to 181D). The four optical sensors 181 correspond to four ink cartridges 100 inserted into the cartridge mounting portion 202. In FIG. 4, the rightmost optical sensor 181D is concealed by the side wall of the frame 204. The four optical sensors 181 (181A to 181D) are arranged in a line in the width direction, that is, in the lateral direction of the cartridge mounting portion 202. That is, the optical sensors are arranged in the same direction as an arrangement direction in which the ink cartridges 100 inserted into the cartridge mounting portion 202 are arranged. The gap between the adjacent optical sensors 181 (181A to 181D) is substantially equal to that between adjacent four ink cartridges 100. Specifically, the gap between the adjacent optical sensors 181 (181A to 181D) is smaller than the thickness of the plate 223 interposed between the optical sensors.

Each of the optical sensors 181 is used to detect whether the amount of ink in the ink chamber 102 of the ink cartridge 100 is less than a threshold value. Each of the optical sensors 181 includes the light-emitting element 154 such as an LED, the light-receiving element 155 such as a phototransistor, and a resin housing 158. In each of the optical sensors 181, the light-emitting element 154 and the light-receiving element 155 are provided in the housing 158. As shown in FIG. 8, each of the housings 158 includes a base portion 149 and two protruding portions 159 protrude from both sides of the base portion 149. Of the two protruding portions 159, one protruding portion 159 (the right protruding portion 159 in FIG. 8) has the light-emitting element 154 accommodated therein, and the other protruding portion 159 (the left protruding portion 159 in FIG. 8) has the light-receiving element 155 accommodated therein.

Each of the light-emitting element 154 and the light-receiving element 155 has two terminals 153 at the lower end of an element body 156. The two terminals 153 extend from the rear surface of the housing 158, which faces the substrate 152, to the outside of the housing 158, with the light-emitting element 154 and the light-receiving element 155 being provided in the protruding portions 159. Although not shown in the drawings, a plurality of through holes are formed in the substrate 152 so as to pass through the front and rear surfaces of the substrate 152. The terminals 153 of the light-emitting elements 154 and the light-receiving elements 155 pass through the through holes. The leading ends of the terminals 153 of the light-emitting elements 154 and the light-receiving elements 154 are soldered to the rear surface of the substrate 152, with the terminals 153 passing through the through holes of the substrate 152.

Each of the light-emitting element 154 and the light-receiving element 155 includes a protrusion 151 provided on the side surface of the element body 156 (see FIGS. 8 and 9). The protrusion 151 is for engaging the element body 156 with the protruding portion 159. As shown in FIG. 9, the element body 156 is fixed to the protruding portion 159 by fitting the protruding portion 159 into a slit 160 of the housing 158. That is, the element body 156 is prevented from being detached from the protruding portion 159.

The housing 158 is formed in a substantially U-shape by a plurality of resin members. Although not shown in the drawings, openings that communicate with the inside of the protruding portions 159 are formed in the rear surface of the housing 158, which faces the substrate 152. The openings are used to insert the light-emitting element 154 and the light-receiving element 155 into the two protruding portions 159. Therefore, the openings are formed in sufficient size and shape to insert the light-emitting element 154 and light-receiving element 155 into the protruding portions 159. The light-emitting element 154 and the light-receiving element 155 are inserted into the two protruding portions 159 through the openings. In this way, in the housing 158, the light-emitting element 154 is accommodated in one of the two protruding portions 159 protruding from the substrate 152, and the light-receiving element 155 is accommodated in the other protruding portion 159. As a result, the light-emitting element 154 and the light-receiving element 155 are arranged so as to face each other.

An opening 164 is formed in a side surface 168 of each of the protruding portions 159. The openings 164 are provided in the side surfaces of the two protruding portions 159 of the housing 158 so as to face each other. Light is emitted from the light-emitting element 154 to the light-receiving element 155. Specifically, light emitted from the light-emitting element 154 passes through the opening 164 of the protruding portion 159 having the light-emitting element 154 provided therein and then travels to the outside of the protruding portion 159. Then, the light travels to the inside of the protruding portion 159 having the light-receiving element 155 provided therein through the opening 164 of the protruding portion 159, and is then received by the light-receiving element 155. Since light emitted from the light-emitting element 154 is received by the light-receiving element 155 in this way, an optical path 183 through which light travels is formed in a space between the light-emitting element 154 and the light-receiving element 155. The light-receiving element 155, which receives light emitted from the light-emitting element 154, outputs a signal having a level corresponding to the brightness (intensity) of the received light to a main control unit (not shown) of the image recording apparatus.

The slit 160 is provided in a side surface 169 of each of the protruding portions 159. In the protruding portion 159, the slit 160 is formed in the side surface 169 that is opposite to the side surface 168 having the opening 164 formed therein. The slits 160 are provided in the two protruding portions 159 of the housing 158. As shown in FIG. 9, the slit 160 is formed by continuously cutting out the tip surface (the upper surface in FIG. 8) of the protruding portion 159 and the side surface 169. As described above, the protrusion 151 of the element body 156 is fitted into the slit 160. Therefore, the slit 160 has sufficient size and shape to accommodate the protrusion 151 inserted thereinto. Since the slit 160 is provided in each of the protruding portions 159 of the housing 158, it is possible to simply fix the light-emitting element 154 and the light-receiving element 155 to the protruding portions 159.

As shown in FIG. 7, the light-emitting element 154 and the light-receiving element 155 are spaced apart from each other in the same direction as that in which the optical sensors 181 are arranged, that is, in the width direction of the cartridge mounting portion 202. That is, the light-emitting element 154 and the light-receiving element 155 are arranged such that the optical path 183 from the light-emitting element 154 to the light-receiving element 155 is aligned with the direction in which the four ink cartridges 100 are arranged. The sensor unit 150 is arranged such that the optical sensors 181 are disposed at positions corresponding to the detecting portions 140 of the ink cartridges 100. That is, the radiation region 144 of the detecting portion 140 faces to the optical path 183 of the optical sensor 181.

When light is emitted from the light-emitting element 154 with the ink cartridge 100 inserted into the cartridge mounting portion 202, the light is incident on the radiation region 144 of the detecting portion 140. At the first position where the indicator 72 is arranged inside the radiation region 144, light traveling to the light-receiving element 155 through the radiation region 144 (see FIGS. 3A, 3B) is shielded by the indicator 72. On the other hand, at the second position where the indicator 72 is arranged outside the radiation region 144, light passing through the radiation region 144 travels to the light-receiving element 155 through a side wall opposite to the incident side, without being shielded by the indicator 72. In this exemplary embodiment, when the light-receiving element 155 receives light and an output signal is higher than a threshold level, the main control unit determines that the amount of ink in the ink chamber 102 is less than a threshold value. When no light is received by the light-receiving element 155 and the output signal is lower than the threshold level, the main control unit determines that the amount of ink in the ink chamber 102 is more than the threshold value.

In this exemplary embodiment, as shown in FIG. 7, the light-emitting elements 154 or the light-receiving elements 155 of adjacent optical sensors 181 are arranged adjacent to each other. Specifically, in the optical sensors 181A and 181B, the light-emitting element 154 of the optical sensor 181A and the light-emitting element 154 of the optical sensor 181B are adjacent to each other. In the optical sensors 181B and 181C, the light-receiving element 155 of the optical sensor 181B and the light-receiving element 155 of the optical sensor 181C are adjacent to each other. Further, in the optical sensors 181C and 181D, the light-emitting element 154 of the optical sensor 181C and the light-emitting element 154 of the optical sensor 181D are adjacent to each other. In other words, a direction from the light-emitting element 154 to the light-receiving element 155 of the optical sensor 181A is opposite to a direction from the light-emitting element 154 to the light-receiving element 155 of 181B adjacent to the optical sensor 181A. Additionally, the direction from the light-emitting element 154 to the light-receiving element 155 of the optical sensor 181B is opposite to a direction from the light-emitting element 154 to the light-receiving element 155 of 181C adjacent to the optical sensor 181B. Further, the direction from the light-emitting element 154 to the light-receiving element 155 of the optical sensor 181C is opposite to a direction from the light-emitting element 154 to the light-receiving element 155 of 181D adjacent to the optical sensor 181C. The operations and effects when the optical sensors 181 are arranged in this way will be described later.

Optical sensors 182 (see FIG. 6) are provided on the ceiling of the cartridge mounting portion 202 at the rear side in the depth direction. The optical sensor 182 is used to detect the upper end of the slider 41 of the ink cartridge 100. In this exemplary embodiment, four optical sensors 182 are provided to correspond to four ink cartridges 100 inserted into the cartridge mounting portion 202. When the ink cartridge 100 is inserted into the cartridge mounting portion 202, the upper end of the slider 41 enters the optical path 184 of the optical sensor 182. In this case, it is possible to determine the inserted state (accommodated state) of the ink cartridge 100 by detecting a variation in the signal of the optical sensor 182.

The frame 204 is provided with the lock levers 230. Each of the lock levers 230 is for fixing (locking) the ink cartridge 100 such that the ink cartridge 100 is not detached from the cartridge mounting portion 202. As shown in FIG. 4, the lock levers 230 are provided in the vicinity of an upper edge 205 of the opening 207 of the frame 204. In this embodiment, four lock levers 230 are provided to correspond to four ink cartridges 100 capable of being inserted into the cartridge mounting portion 202.

As shown in FIG. 10, the lock lever 230 has an arm shape. A supporting shaft 232 is provided in the vicinity of the center of the lock lever 230. The supporting shafts 232 are rotatably supported by the frame 204. In this way, the lock levers 230 are supported by the frame 204 such that they can rotate on the supporting shafts 232 in the vicinity of the upper edge 205 of the frame 204. Each of the lock levers 230 includes an input portion 234 and an operating portion 236. A spring 219 is fixed to the operating portion 236. Therefore, the lock lever 230 receives from the spring 219 turning force in the direction of an arrow 245 in FIG. 10 (the clockwise direction in FIG. 10). When the ink cartridge 100 is inserted into the cartridge mounting portion 202, the leading end of the operating portion 236 of the lock lever 230 goes over the stopper 125 and is placed on the upper surface of the table portion 124. In this way, the movement of the ink cartridge 100 backward is regulated by the lock lever 230. As a result, the ink cartridge 100 is reliably fixed to the cartridge mounting portion 202.

Figure 11:
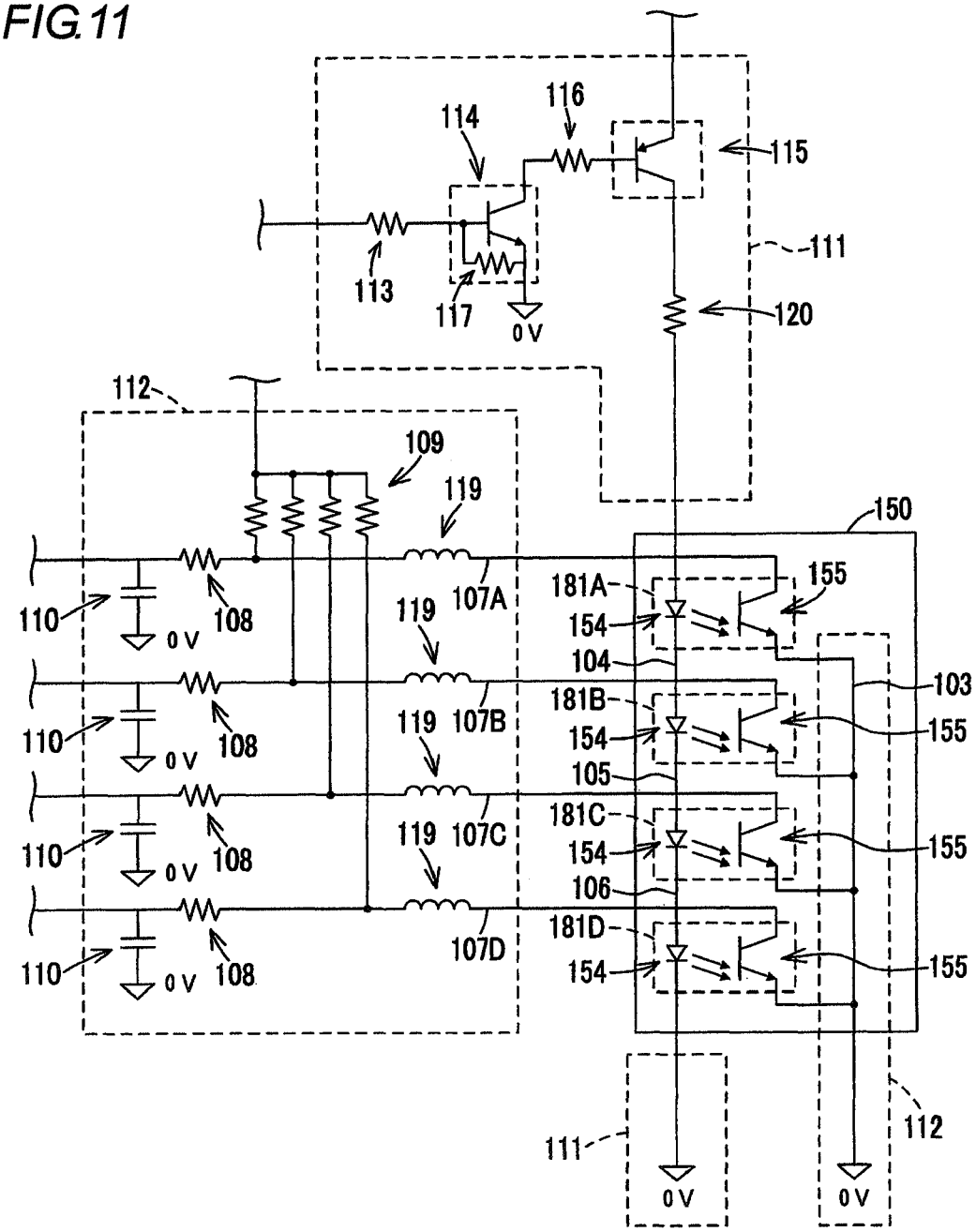
FIG. 11 is a circuit diagram illustrating the base unit.
Figure 12:
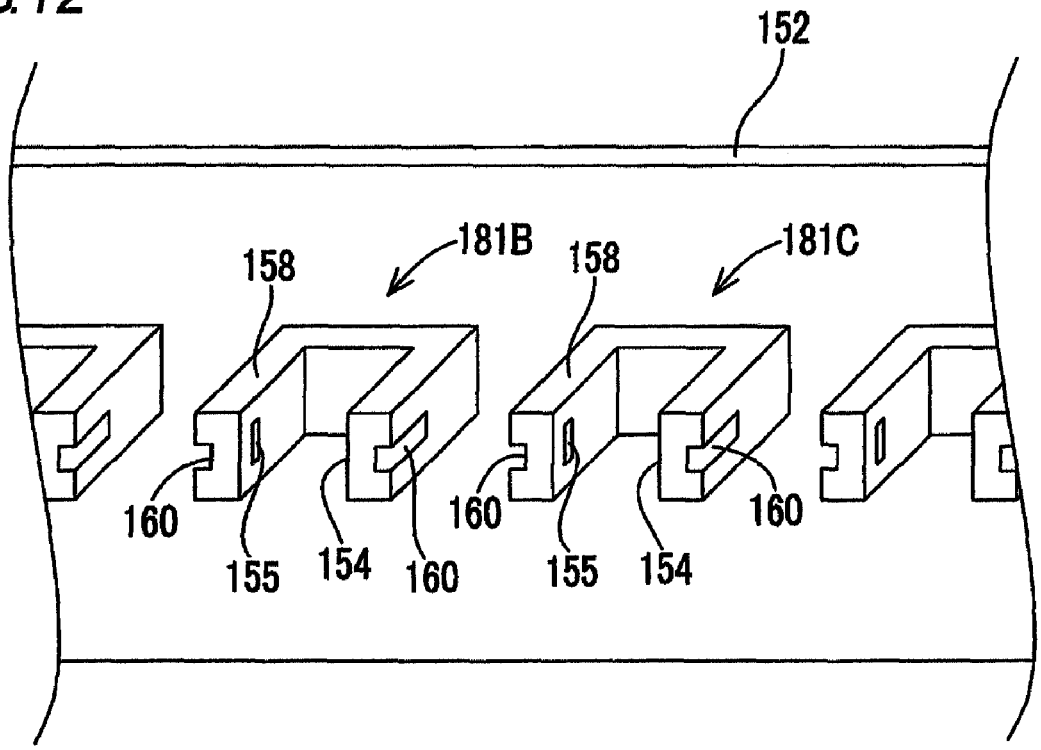
FIG. 12 is a perspective view illustrating the arrangement of sensors according to related art.

Next the circuit configuration and the operation of the base unit 200 will be described. FIG. 11 is a circuit diagram illustrating the base unit 200. FIG. 12 is a perspective view illustrating the arrangement of sensors according to related art.

As shown in FIG. 11, the base unit 200 includes the sensor unit 150, a supply circuit 111, and an output circuit 112. The supply circuit 111 supplies power to the light-emitting elements 154 of the optical sensors 181A to 181D of the sensor unit 150. The output circuit 112 outputs signals from the light-receiving elements 155 of the optical sensors 181A to 181D to the main control unit (not shown) through signal lines 107A to 107D, which are transmission media.

The supply circuit 111 includes a resistor 113, an npn transistor 114, a pnp transistor 115, and a resistor 120. The npn transistor 114 and the pnp transistor 115 serve as switches that connect or disconnect power supply paths to the light-emitting elements 154 of the optical sensors 181A to 181D. The base of the npn transistor 114 is connected to the main control unit through the resistor 113. The base and the emitter of the npn transistor 114 are connected to each other through a resistor 117. The emitter of the npn transistor 114 is connected to the ground. The collector of the npn transistor 114 is connected to the base of the pnp transistor 115 through a resistor 116. The emitter of the pnp transistor 115 is connected to a power line of a power supply (not shown). The collector of the pnp transistor 115 is connected to an anode of the light-emitting element 154 of the optical sensor 181A through the resistor 120.

The sensor unit 150 includes the optical sensors 181 (181A to 181D). The light-emitting elements 154 of the optical sensors 181A to 181D are LEDs in this exemplary embodiment. The anode of the light-emitting element 154 of the optical sensor 181A is connected to the collector of the pnp transistor 115 through the resistor 120. The cathode of the light-emitting element 154 of the optical sensor 181D is connected to the ground. The cathode of the light-emitting element 154 of the optical sensor 181A and the anode of the light-emitting element 154 of the optical sensor 181B are connected to each other by a jumper wire 104. The cathode of the light-emitting element 154 of the optical sensor 181B and the anode of the light-emitting element 154 of the optical sensor 181C are connected to each other by a jumper wire 105. The cathode of the light-emitting element 154 of the optical sensor 181C and the anode of the light-emitting element 154 of the optical sensor 181D are connected to each other by a jumper wire 106. In this way, the light-emitting elements 154 of the optical sensors 181 are connected in series to one another. Therefore, when power is supplied from the supply circuit 111, the light-emitting elements 154 of the optical sensors 181A to 181D emit light at the same time.

Since the light-emitting elements 154 of the optical sensors 181 are connected in series to one another, it is not necessary to individually connect the supply circuit 111 to the light-emitting elements 154 of the optical sensors 181, as compared to the configuration in which the light-emitting elements 154 of the optical sensors 181 are connected in parallel to each other. Therefore, it is possible to decrease the number of lines connected to the light-emitting elements 154 of the optical sensors 181 and reduce the size of the base unit 200.

The light-receiving elements 155 of the optical sensors 181A to 181D are phototransistors in this exemplary embodiment. The collectors of the light-receiving elements 155 of the optical sensors 181A to 181D are individually connected to signal lines 107 (107A to 107D). The emitters of the light-receiving elements 155 of the optical sensors 181A to 181D are connected to a common line 103 that is grounded.

The output circuit 112 includes resistors 109, coils 119, resistors 108, and capacitors 110. The coils 119 and the resistors 108 are provided in the signal lines 107 (107A to 107D) of the output circuit 112. The signal lines 107 (107A to 107D) transmit signals output from the light-receiving elements 155 of the optical sensors 181A to 181D, and are connected to the main control unit (not shown). The resistor 109 has one end connected to the power supply (not shown) and the other end connected to a connection point between the coil 119 and the resistor 108 of the signal line 107. The signal lines 107A to 107D are connected to the ground through the capacitors 110. Since the resistor 109, the coil 119, the resistor 108, and the capacitor 110 are known elements for stabilizing the signal output from the light-receiving element 155, a detailed description thereof will be omitted.

When control signals are transmitted from the main control unit to the base of the npn transistor 114, the collector and the emitter of the npn transistor 114 are electrically connected to each other. Then, a current flows from the base of the pnp transistor 115 to the collector of the npn transistor 114. As a result, the emitter and the collector of the pnp transistor 115 are electrically connected to each other, and a current flows from the power supply (not shown) connected to the emitter of the pnp transistor 115 to the light-emitting elements 154 of the optical sensors 181A to 181D. That is, power is supplied from the supply circuit 111 to the light-emitting elements 154 of the optical sensors 181A to 181D. As described above, since the light-emitting elements 154 of the optical sensors 181A to 181D are connected in series to one another, the light-emitting elements 154 of the optical sensors 181A to 181D emit light at the same time (simultaneously).

As described above, when the supply circuit 111 supplies power to the light-emitting elements 154 of the optical sensors 181, the light-emitting elements 154 emit light. When the light-receiving elements 155 of the optical sensors 181 receive the light emitted from the light-emitting elements 154 of the same optical sensors 181, the light-receiving elements 155 output signals having a level corresponding to the received light through the signal lines 107. The light-receiving elements 155 of the optical sensors 181A to 181D are connected to the signal lines 107A to 107D, respectively. Therefore, the output circuit 112 outputs the signal from the light-receiving element 155 of the optical sensor 181A to the main control unit through the signal line 107A, and outputs the signal from the light-receiving element 155 of the optical sensor 181B to the main control unit through the signal line 107B. In addition, the output circuit 112 outputs the signal from the light-receiving element 155 of the optical sensor 181C to the main control unit through the signal line 107C, and outputs the signal from the light-receiving element 155 of the optical sensor 181D to the main control unit through the signal line 107D. The signals output through the signal lines have different levels based on whether light emitted from the light-emitting element 154 is received by the light-receiving element 155. Therefore, it is possible to determine the state of the ink cartridges 100 on the basis of the levels of the signals transmitted through the signal lines 107A to 107D corresponding to the light-receiving elements 155.

However, as described above, since the slit 160 is provided in the protruding portion 159, light emitted from the light-emitting element 154 might leak to the outside of the protruding portion 159 through the slit 160. In the related art, adjacent optical sensors 181 are arranged in the same direction. That is, as shown in FIG. 12, adjacent optical sensors 181B and 181C are arranged in the same direction such that the light-emitting element 154 of the optical sensor 181B and the light-receiving element 155 of the optical sensor 181C are adjacent to each other. In the arrangement of the sensors, when the light-emitting elements 154 of the optical sensors 181B and 181C emit light at the same time, the following problems might arise. For example, when a signal is output from the light-receiving element 155 of the optical sensor 181C, it is difficult to determine whether the signal is generated from light emitted from the light-emitting element 154 of the optical sensor 181C or light leaking from the light-emitting element 154 of the optical sensor 181B. When the light-receiving element 155 of the optical sensor 181C receives light leaking from the light-emitting element 154 of the optical sensor 181B and outputs a signal, a detection error may occur in the optical sensor 181C.

In order to reduced or prevent the leakage of light from the light-emitting element 154 causing the detection error of the optical sensor 181, the light-emitting element 154 and the light-receiving element 155 may be fixed to the protruding portions 159 and the slits 160 may be covered. However, if the slit 160 is covered, although it is possible to reduce or prevent the leakage of light from the light-emitting element 154, it is complicated to assemble the sensor unit 150.

As described above, in this exemplary embodiment, as shown in FIG. 7, the light-emitting elements 154 or the light-receiving elements 155 of adjacent optical sensors 181 are arranged adjacent to each other. Therefore, the light-emitting element 154 of one of the optical sensors 181 is not adjacent to the light-receiving element 155 of the adjacent optical sensor 181. Therefore, it is possible to reduce or prevent light emitted from the light-emitting element 154 of one of the adjacent optical sensors from being incident on the light-receiving element 155 of the other optical sensor. Thus, the cutout 224 can be formed in the plate 223 provided between adjacent optical sensors 181 to reduce the gap between the optical sensors 181. In this way, it is possible to reduce the width of the frame 204 of the base unit 200. As a result, it is possible to reduce the size of an image recording apparatus including the base unit 200.

Further, in this exemplary embodiment, since the cutout 224 is formed in the plate 223, it is possible to use a space corresponding to the thickness of the cutout 224 to arrange the optical sensor 181. In this way, the gap between adjacent optical sensors 181 can be smaller than the thickness of the plate 223. It is noted that since the cutout 224 is formed in the plate 223, it is possible to prevent the optical sensor 181 from contacting the plate 223.

[Modifications]

Figure 13:
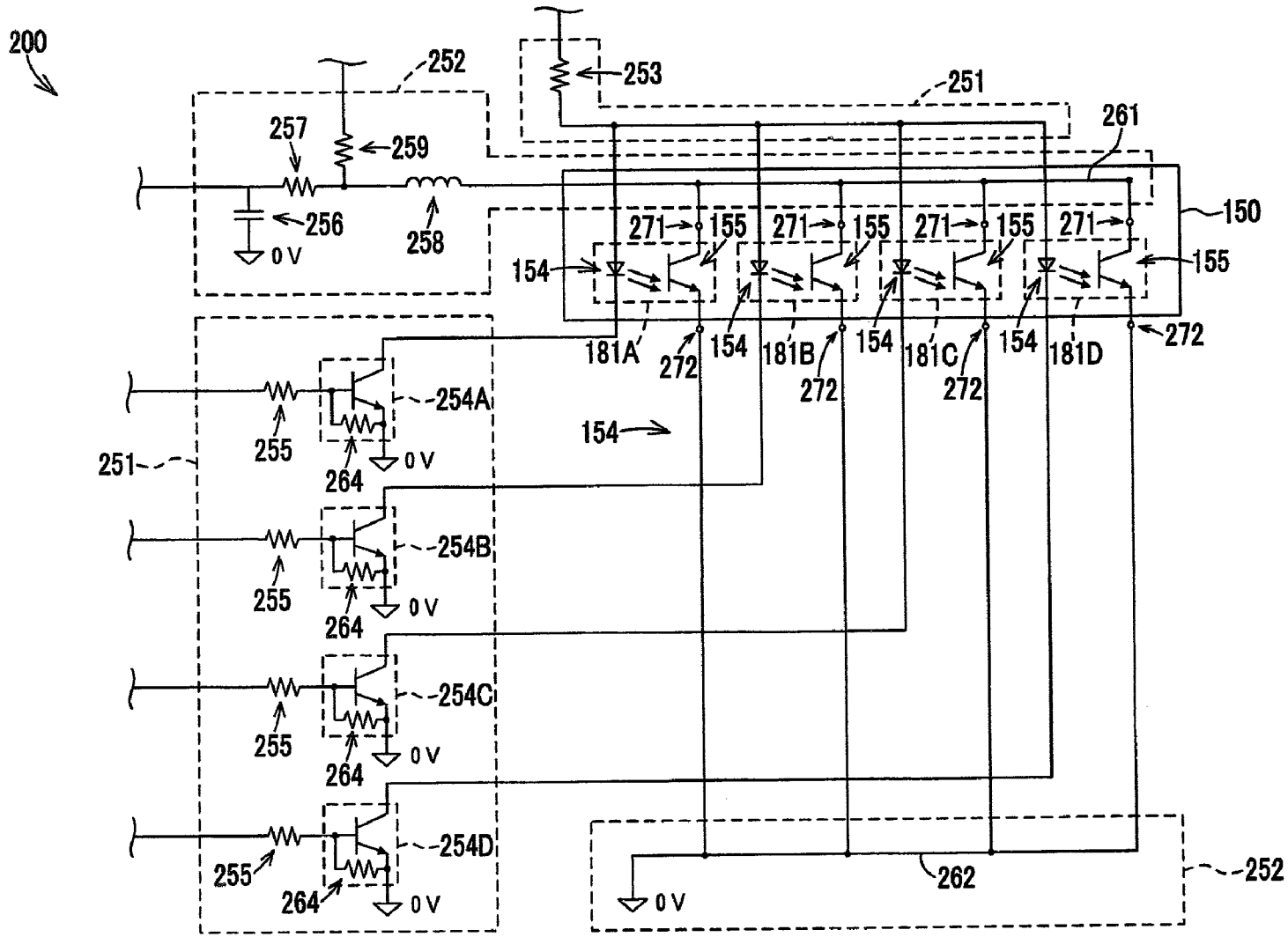
FIG. 13 is a circuit diagram illustrating a base unit according to a modification of the exemplary embodiment of the present invention.
Figure 14A:
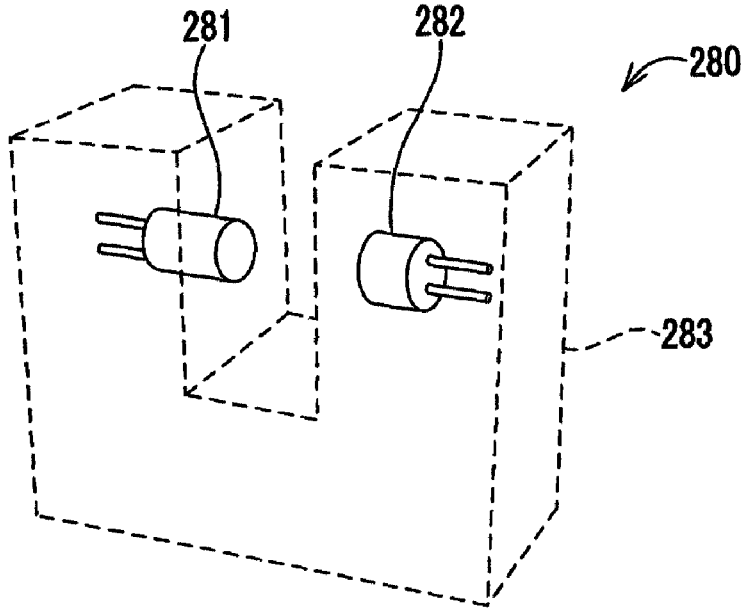
FIGS. 14A and 14B are perspective views illustrating an optical sensor used for an ink-jet recording apparatus according to related art.
Figure 14B:
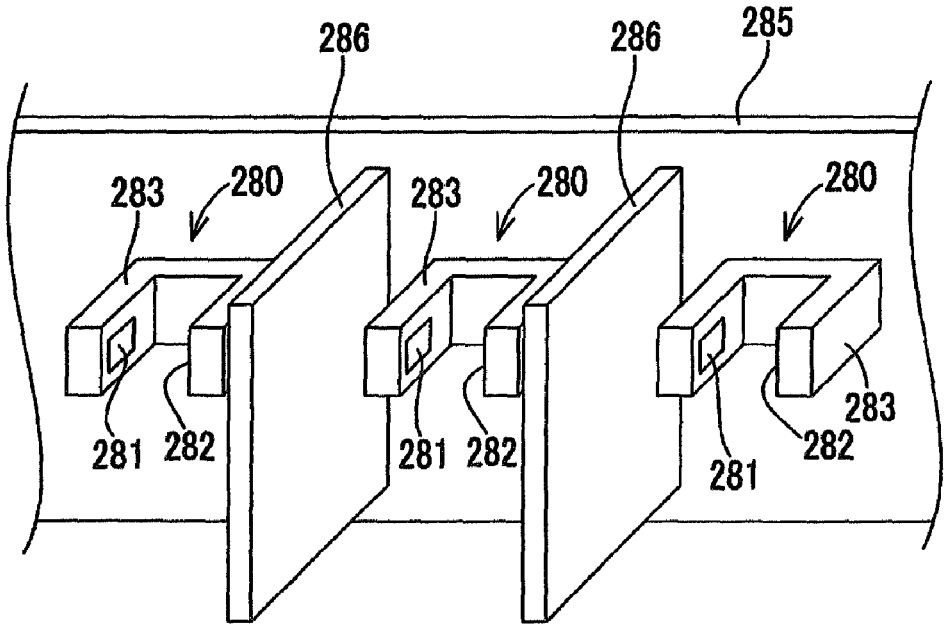

The base unit 200 may have a circuit configuration in which the light-emitting elements 154 of the optical sensors 181A to 181D emit light at different timings and signals output from the light-receiving elements 155 of the optical sensors 181A to 181D are transmitted through a common line. FIG. 13 is a circuit diagram illustrating the base unit 200 according to a modification of the exemplary embodiment of the present invention.

As shown in FIG. 13, the base unit 200 includes the sensor unit 150, a supply circuit 251, and an output circuit 252. The supply circuit 251 supplies power to the light-emitting elements 154 of the optical sensors 181A to 181D of the sensor unit 150. The output circuit 252 outputs signals from the light-receiving elements 155 of the optical sensors 181A to 181D to a main control unit (not shown) through common lines 261 and 262.

The supply circuit 251 includes a resistor 253, switches 254 (254A to 254D), and a resistor 255. The resistor 253 has one end connected to a power supply (not shown) and the other end connected to the anodes of the light-emitting elements 154 of the optical sensors 181A to 181D. The switches 254A to 254D are npn transistors each having a base and an emitter connected to each other through a resistor 264. The cathode of the light-emitting element 154 of the optical sensor 181A is connected to the collector of the switch 254A, and the cathode of the light-emitting element 154 of the optical sensor 181B is connected to the collector of the switch 254B. In addition, the cathode of the light-emitting element 154 of the optical sensor 181C is connected to the collector of the switch 254C, and the cathode of the light-emitting element 154 of the optical sensor 181D is connected to the collector of the switch 254D. As such, the light-emitting elements 154 of the optical sensors 181A to 181D are connected in parallel to the power supply (not shown) connected to one end of the resistor 253. The emitters of the switches 254A to 254D are all connected to the ground. In addition, the bases of the switches 254A to 254D are connected to the main control unit (not shown) through resistors 255.

When the main control unit (not shown) transmits control signals to the bases of the switches 254, the collector and the emitter of each of the switches 254 are electrically connected to each other. In this way, a current flows to the light-emitting element 154 of the optical sensor 181. That is, power is supplied from the supply circuit 251 to the light-emitting element 154 and the light-emitting element 154 emits light. The switches 254 having the bases to which the control signals are input are appropriately selected. In this way, the light-emitting elements 154 of the optical sensors 181A to 181D emit light in the order, for example, of the light-emitting element 154 of the optical sensor 181A, the light-emitting element 154 of the optical sensor 181B, the light-emitting element 154 of the optical sensor 181C, and the light-emitting element 154 of the optical sensor 181D. That is, the light-emitting elements 154 of the optical sensors 181A to 181D emit light at different timings.

The output circuit 252 includes a resistor 259, a coil 258, a resistor 257, and a capacitor 256.

The resistor 259 has one end connected to the power supply (not shown) and the other end connected to a connection point between the resistor 257 and the coil 258 of the first common line 261. The first common line 261 and the second common line 262 of the output circuit 252 transmit signals output from the light-receiving elements 155 of the optical sensors 181A to 181D. The first common line 261 is connected to first terminals 271 of the light-receiving elements 155 of the optical sensors 181A to 181D. That is, the first common line 261 is for connecting the collectors of the light-receiving elements 155 of the optical sensors 181A to 181D. The first common line 261 is connected to the main control unit (not shown). The second common line 262 is connected to second terminals 272 of the light-receiving elements 155 of the optical sensors 181A to 181D. That is, the second common line 262 is for connecting the emitters of the light-receiving elements 155 of the optical sensors 181A to 181D. The second common line 262 is connected to the ground. As such, the light-receiving elements 155 of the optical sensors 181A to 181D are connected in series to one another between the first common line 261 and the second common line 262. Since the resistor 259, the coil 258, the resistor 257, and the capacitor 256 are known elements for stabilizing the signals output from the light-receiving elements 155, a detailed description thereof will be omitted.

As described above, in the light-receiving elements 155 of the optical sensors 181A to 181D, the first terminals 271 are connected to the first common line 261, and the second terminals 272 are connected to the second common line 262. Therefore, the output circuit 252 outputs signals to the main control unit through the common lines 261 and 262 when any of the light-receiving elements 155 of the optical sensors 181A to 181D receives light. In this way, it is possible to simplify the circuit configuration of the base unit 200, as compared to the configuration in which a line for outputting a signal is provided for each light-receiving element 155. As a result, it is possible to reduce the size of the base unit 200.

As described above, in the related art, adjacent optical sensors 181B and 181C are arranged in the same direction such that the light-emitting element 154 of the optical sensor 181B and the light-receiving element 155 of the optical sensor 181C are adjacent to each other (see FIG. 12). In the arrangement of the sensors, for example, when signals are output through the common lines 261 and 262 while light is emitted from the light-emitting element 154 of the optical sensor 181B, the following problems might arise. For example, it is difficult to determine whether the signals transmitted through the common lines 261 and 262 are output from the light-receiving element 155 of the optical sensor 181B having received light emitted from the light-emitting element 154 of the optical sensor 181B, or the light-receiving element 155 of the optical sensor 181C having received light leaking from the light-emitting element 154 of the optical sensor 181B. When the signals transmitted through the common lines 261 and 262 are output from the light-receiving element 155 of the optical sensor 181C having received light leaking from the light-emitting element 154 of the optical sensor 181B, a detection error may occur in the optical sensor 181C. However, in this exemplary embodiment, as described above, it is possible to effectively reduce or prevent the detection error of the optical sensor 181 by arranging the optical sensors 181 such that the light-emitting elements 154 or the light-receiving elements 155 of adjacent optical sensors 181 are adjacent to each other.

In the above-described exemplary embodiment, the present invention is applied to the optical sensors 181 for detecting whether the amount of ink in the ink chamber 102 is more than a threshold value, but the present invention is not limited thereto. For example, the inventive concept of the present invention can be applied to the optical sensor 182 for detecting whether the ink cartridge 100 is inserted into the cartridge mounting portion 202.

What is claimed is:

1. An ink cartridge accommodating device comprising:

an accommodating portion which is configured to accommodate a plurality of ink cartridges arranged in an arrangement direction; and a plurality of sensors which are provided correspondingly to the plurality of ink cartridges, and which optically detect information related to the plurality of ink cartridges, respectively;

wherein each of the sensors includes:

a light-emitting element which emits light; and a light-receiving element which receives light emitted from the light emitting element;

wherein:

the light-emitting elements of the sensors provided for adjacent ink cartridges are arranged adjacent to each other without the light-receiving elements of the sensors provided for the adjacent ink cartridges interposed therebetween; or the light-receiving elements of the sensors provided for adjacent ink cartridges are arranged adjacent to each other without the light-emitting elements of the sensors provided for the adjacent ink cartridges interposed therebetween; and wherein the ink cartridge accommodating device further comprises:

a first supply unit which supplies power to the light-emitting elements of the sensors so that the light-emitting elements of adjacent sensors emit light at the same time; and a first output unit which outputs signals from the light-receiving elements of the sensors through a plurality of lines connected to the light-receiving elements of the sensors, respectively.

2. The ink cartridge accommodating device according to claim 1;

wherein, in each of the sensors, the light-emitting element emits light to a specific portion of the corresponding one of the ink cartridges and the light-receiving element receives light passing through the specific portion to detect the information related to the corresponding one of the ink cartridges.

3. The ink cartridge accommodating device according to claim 1;

wherein, in each of the sensors, the light-emitting element and the light-receiving element are arranged so that an optical path from the light-emitting element to the light-receiving element is aligned in the arrangement direction.

4. The ink cartridge accommodating device according to claim 1, further comprising:

a partition plate which has a cutout provided in a portion corresponding to the sensors, and which partitions an inner space of the accommodating portion into spaces for the respective ink cartridges.

5. The ink cartridge accommodating device according to claim 2;

wherein each of the ink cartridges comprises:

an arm member supported to be pivotable according to an amount of ink therein;

a first end portion which is provided at one end of the arm member and is movable between a first position where the first end portion is located inside the specific region and a second position where the first end portion is located outside the specific region, according to the pivoting of the arm member; and a second end portion which is provided at the other end of the arm member and is movable according to the amount of ink therein.

6. The ink cartridge accommodating device according to claim 1;

wherein the information related to the ink cartridge includes information on an amount of ink in the ink cartridge.

7. The ink cartridge accommodating device according to claim 1;

wherein the information related to the ink cartridge includes information on an accommodated state of the ink cartridge in the accommodating portion.

8. The ink cartridge accommodating device according to claim 1, further comprising:

a control unit which controls the light-emitting elements to emit light to the light-receiving elements, respectively, at the same time.

9. The ink cartridge accommodating device according to claim 1;

wherein the light-emitting elements of the sensors are connected in series to one another.

10. An ink cartridge accommodating device comprising:

an accommodating portion which is configured to accommodate a plurality of ink cartridges arranged in an arrangement direction; and a plurality of sensors which are provided correspondingly to the plurality of ink cartridges, and which optically detect information related to the plurality of ink cartridges, respectively;

wherein each of the sensors includes:

a light-emitting element which emits light; and a light-receiving element which receives light emitted from the light emitting element;

wherein:

th light-emitting elements of the sensors provided for adjacent ink cartridges are arranged adjacent to each other without the light-receiving elements of the sensors provided for the adjacent ink cartridges interposed therebetween; or the light-receiving elements of the sensors provided for adjacent ink cartridges are arranged adjacent to each other without the light-emitting elements of the sensors provided for the adjacent ink cartridges interposed therebetween; and wherein the ink cartridge accommodating device further comprises:

a second supply unit which supplies power to the light-emitting elements of the sensors so that the light-emitting elements of the sensors emit light at different timings; and a second output unit which outputs signals from the light-receiving elements of the sensors through a common line connected to the plurality of light-receiving elements.

11. The ink cartridge accommodating device according to claim 10;

wherein the light-receiving elements of the sensors are connected in parallel to one another; and wherein the common line includes a first common line connected to first terminals of the light-receiving elements of the sensors and a second common line connected to second terminals of the light-receiving elements of the sensors.

12. The ink cartridge accommodating device according to claim 10;

wherein, in each of the sensors, the light-emitting element emits light to a specific portion of the corresponding one of the ink cartridges and the light-receiving element receives light passing through the specific portion to detect the information related to the corresponding one of the ink cartridges.

13. The ink cartridge accommodating device according to claim 10;

wherein, in each of the sensors, the light-emitting element and the light-receiving element are arranged so that an optical path from the light-emitting element to the light-receiving element is aligned in the arrangement direction.

14. The ink cartridge accommodating device according to claim 10, further comprising:

a partition plate which has a cutout provided in a portion corresponding to the sensors, and which partitions an inner space of the accommodating portion into spaces for the respective ink cartridges.

15. The ink cartridge accommodating device according to claim 12;

wherein each of the ink cartridges comprises:

an arm member supported to be pivotable according to an amount of ink therein;

a first end portion which is provided at one end of the arm member and is movable between a first position where the first end portion is located inside the specific region and a second position where the first end portion is located outside the specific region, according to the pivoting of the arm member; and a second end portion which is provided at the other end of the arm member and is movable according to the amount of ink therein.

16. The ink cartridge accommodating device according to claim 10; wherein the information related to the ink cartridge includes reformation on an amount of ink in the ink cartridge.

17. The ink cartridge accommodating device according to claim 10; wherein the information related to the ink cartridge includes information on an accommodated state of the ink cartridge in the accommodating portion.

* * * * *